US009527314B2

(12) United States Patent
Moriguchi et al.

(10) Patent No.: US 9,527,314 B2
(45) Date of Patent: Dec. 27, 2016

(54) INK JET RECORDING METHOD

(71) Applicant: CANON KABUSHIKI KAISHA, Tokyo (JP)

(72) Inventors: Takuto Moriguchi, Kamakura (JP); Eisuke Nishitani, Tokyo (JP); Koichiro Nakazawa, Machida (JP); Takumi Otani, Kawasaki (JP); Takayuki Sekine, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/097,620

(22) Filed: Apr. 13, 2016

(65) Prior Publication Data

US 2016/0303870 A1 Oct. 20, 2016

(30) Foreign Application Priority Data

Apr. 16, 2015 (JP) ..... 2015-084373
Apr. 16, 2015 (JP) ..... 2015-084374

(51) Int. Cl.
*G03G 13/20* (2006.01)
*B41J 11/00* (2006.01)
*B41J 2/01* (2006.01)

(52) U.S. Cl.
CPC ..... *B41J 11/002* (2013.01); *B41J 2/01* (2013.01)

(58) Field of Classification Search
CPC ..... B41J 11/00; B41J 11/002; B41J 11/0015; B41J 2/2114; G03G 13/20; G03G 2215/00413
See application file for complete search history.

(56) References Cited

U.S. PATENT DOCUMENTS

| | | | | |
|---|---|---|---|---|
| 4,538,156 | A | 8/1985 | Durkee et al. | |
| 5,099,256 | A | 3/1992 | Anderson | |
| 7,048,356 | B2 | 5/2006 | Ishikawa et al. | |
| 7,226,157 | B2 | 6/2007 | Nakazawa et al. | |
| 7,241,544 | B2 * | 7/2007 | Ohmura | G03G 13/20 430/108.3 |
| 8,478,151 | B2 * | 7/2013 | Iguchi | G03G 13/20 347/101 |

(Continued)

FOREIGN PATENT DOCUMENTS

| | | | |
|---|---|---|---|
| JP | 62-92849 | A | 4/1987 |
| JP | 2005-178291 | A | 7/2005 |

*Primary Examiner* — Kristal Feggins
(74) *Attorney, Agent, or Firm* — Fitzpatrick, Cella, Harper & Scinto

(57) ABSTRACT

An ink jet recording method includes forming first and second liquid composition aggregated layers by respectively applying first and second liquid compositions containing resin to a recording medium using an ink jet recording head; performing heating and pressurization of the medium in a first fixation step using a first fixing unit; and performing heating and pressurization of the medium in a second fixation step using a second fixing unit followed by cooling to separate the medium from the second fixing unit. MFT1>MFT2 and T1>MFT1≥T2>MFT2≥T3 are satisfied, where MFT1, MFT2 are, respectively, minimum film forming temperatures of the first and second liquid composition aggregated layers, and T1, T2, and T3 are temperatures of the first and second liquid composition aggregated layers upon heating and pressurization in first and second fixation steps and upon separation in second fixation step, respectively.

14 Claims, 10 Drawing Sheets

(56) References Cited

U.S. PATENT DOCUMENTS

| | | | | |
|---|---|---|---|---|
| 8,843,011 | B2 * | 9/2014 | Iritani | G03G 15/205 399/67 |
| 2015/0273919 | A1 | 10/2015 | Otani et al. | |

* cited by examiner

INK JET RECORDING METHOD

BACKGROUND OF THE INVENTION

Field of the Invention

The present invention relates to an ink jet recording method.

Description of the Related Art

There has been proposed such an ink jet recording method that a liquid composition containing resin particles is applied to a recording medium, then the recording medium is fixed with a fixing unit to form a film of the resin microparticles contained in the liquid composition on the recording medium, thereby creating a recorded image. When this method is used to make a recorded image into a film, the scratch resistance of the recorded image can be improved, and a high gloss recorded image can be obtained.

Japanese Patent Application Laid-Open No. 2005-178291 discloses an image recorder including a surface property selection unit for imparting a desired gloss by selecting a unit from a plurality of fixing units.

SUMMARY OF THE INVENTION

In view of the above circumstances, the inventors of the present invention have performed intensive studies, as a result, have found that the constitution mentioned below has an excellent performance as an ink jet recording method, and have completed the present invention.

An aspect of the present invention provides an ink jet recording method including a step of forming a first liquid composition aggregated layer by applying a first liquid composition containing a resin to a recording medium by using an ink jet recording head; a step of forming a second liquid composition aggregated layer by applying a second liquid composition containing a resin to the recording medium by using an ink jet recording head; a first fixation step of performing heating and pressurization of the recording medium on which the first liquid composition aggregated layer and the second liquid composition aggregated layer are formed by using a first fixing unit; and a second fixation step.

The second fixation step includes performing heating and pressurization of the recording medium subjected to the first fixation step by using a second fixing unit followed by cooling the recording medium to separate the second fixing unit.

In the ink jet recording method, $$MFT1>MFT2, \tag{1-1}$$

and $$T1>MFT1\geq T2>MFT2\geq T3 \tag{1-2}$$

are satisfied, where MFT1 is a minimum film forming temperature of the first liquid composition aggregated layer, MFT2 is a minimum film forming temperature of the second liquid composition aggregated layer, T1 is a temperature of the first liquid composition aggregated layer and the second liquid composition aggregated layer upon the heating and pressurization in the first fixation step, T2 is a temperature of the first liquid composition aggregated layer and the second liquid composition aggregated layer upon the heating and pressurization in the second fixation step, and T3 is a temperature of the first liquid composition aggregated layer and the second liquid composition aggregated layer upon the separation in the second fixation step.

Another aspect of the present invention provides an ink jet recording method including a step of forming a first liquid composition aggregated layer by applying a first liquid composition containing a resin to an intermediate transfer member by using an ink jet recording head; a step of forming a second liquid composition aggregated layer by applying a second liquid composition containing a resin to the intermediate transfer member by using an ink jet recording head; a transfer step of transferring the first liquid composition aggregated layer and the second liquid composition aggregated layer on the intermediate transfer member onto a recording medium; a first fixation step of performing heating and pressurization of the recording medium on which the first liquid composition aggregated layer and the second liquid composition aggregated layer are formed by using a first fixing unit; and a second fixation step.

The second fixation step includes performing heating and pressurization of the recording medium subjected to the first fixation step by using a second fixing unit followed by cooling the recording medium to separate the recording medium from the second fixing unit.

In the ink jet recording method, $$MFT1>MFT2, \tag{2-1}$$

and $$T1>MFT1\geq T2>MFT2\geq T3 \tag{2-2}$$

are satisfied, where MFT1 is a minimum film forming temperature of the first liquid composition aggregated layer, MFT2 is a minimum film forming temperature of the second liquid composition aggregated layer, T1 is a temperature of the first liquid composition aggregated layer and the second liquid composition aggregated layer upon the heating and pressurization in the first fixation step, T2 is a temperature of the first liquid composition aggregated layer and the second liquid composition aggregated layer upon the heating and pressurization in the second fixation step, and T3 is a temperature of the first liquid composition aggregated layer and the second liquid composition aggregated layer upon the separation in the second fixation step.

According to the present invention, an ink jet recording method capable of producing various image patterns of high gloss and low gloss in a recorded image can be provided.

Further features of the present invention will become apparent from the following description of exemplary embodiments with reference to the attached drawings.

DESCRIPTION OF THE EMBODIMENTS

Figure 1:
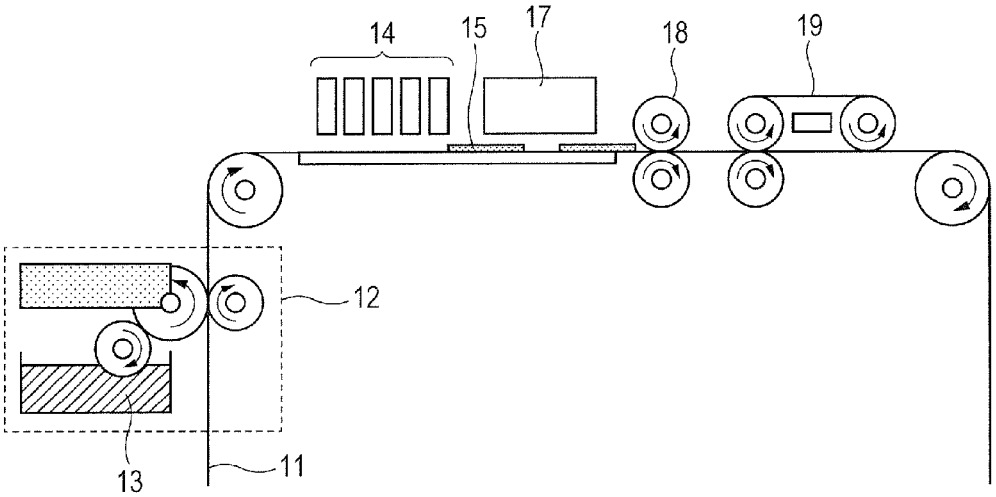
FIG. 1 is a schematic view of a direct drawing type ink jet printer in an embodiment of the present invention.

Preferred embodiments of the present invention will now be described in detail in accordance with the accompanying drawings.

As disclosed in Japanese Patent Application Laid-Open No. 2005-178291, a technique of selecting a unit from a plurality of fixing units in order to impart intended gloss enables an improvement in scratch resistance of a recorded image by heating and pressurization. However, as for the glossiness of a recorded image, this technique can only produce a high gloss image pattern in the whole area, a low gloss image pattern in the whole area, or an image pattern that is divided into a high gloss area and a low gloss area in a paper convey direction, and is unfortunately difficult to produce various image patterns of high gloss and low gloss in a recorded image.

An object of the present invention is to provide an ink jet recording method capable of producing various image patterns of high gloss and low gloss in a recorded image.

An outline of the printing method pertaining to embodiments of the present invention will now be described. In the present specification, the term "recording medium" not only includes paper used in common printing, but also broadly includes fabrics, plastics, films, and other printing media and recording media.

Ink Jet Recording Method

The ink jet recording method of the present invention includes "direct drawing type ink jet recording method" in which liquid compositions are directly applied to a recording medium to record an image and "transfer type ink jet recording method" in which liquid compositions are applied to an intermediate transfer member as a first recording medium to form an intermediate image and then the intermediate image is transferred to a second recording medium such as paper to record an image. The respective ink jet recording methods will be described hereinafter.

[1] Direct Drawing Type Ink Jet Recording Method

An embodiment of the present invention includes a step of forming a first liquid composition aggregated layer on a recording medium and a step of forming a second liquid composition aggregated layer on the recording medium. Subsequent to the steps of forming these liquid composition aggregated layers, the embodiment includes a first fixation step and a second fixation step of performing heating and pressurization of these liquid composition aggregated layers to fix the layers onto the recording medium.

In the step of forming a first liquid composition aggregated layer, a first liquid composition containing a resin is applied to a recording medium by using an ink jet recording head to form a first liquid composition aggregated layer. The step of forming a first liquid composition aggregated layer may include a step of applying onto a recording medium a reaction liquid that causes aggregation of components such as a coloring material in the first liquid composition and a step of applying a first liquid composition onto the recording medium. In the step of forming a second liquid composition aggregated layer, a second liquid composition containing a resin is applied to the recording medium by using an ink jet recording head to form a second liquid composition aggregated layer. This step may include a step of removing water by air blowing or the like. The second liquid composition is preferably applied to an area that at least partly overlaps with an area where the first liquid composition aggregated layer is formed, but no overlap area may be provided.

The order of performing the step of forming a first liquid composition aggregated layer and the step of forming a second liquid composition aggregated layer is not limited to particular orders.

In the first fixation step, the first liquid composition aggregated layer and the second liquid composition aggregated layer are subjected to heating and pressurization with a first fixing unit when the recording medium arrives at the position of the first fixing unit. At this fixation, the first and second liquid composition aggregated layers are heated at a temperature (T1) higher than the minimum film forming temperatures of the first and second liquid composition aggregated layers as shown in Expression (1-2) to be fixed to the recording medium, and a recorded image having scratch resistance is formed.

After the first fixation step, the first and second liquid composition aggregated layers on the recording medium are released from the heating and pressurization by the first fixing unit and are conveyed to a second fixing unit in a second fixation step. During the conveyance, the first and second liquid composition aggregated layers are preferably cooled to a temperature not higher than MFT1. The layers may be cooled to a temperature not higher than MFT2. For the cooling, another unit for cooling may be provided, but for a simple and easy method, a certain distance is provided in such a way that the layers are naturally cooled from the first fixation step until the layers come in contact with the second fixing unit in the second fixation step.

Subsequent to the first fixation step, the second fixation step performs pressurization and heating of the recording medium after the first fixation step once again by using the second fixing unit. The minimum film forming temperature (MFT1) of the first liquid composition aggregated layer and the minimum film forming temperature (MFT2) of the second liquid composition aggregated layer have the relation MFT1>MFT2 as shown in Expression (1-1). In the second fixation step, the layers are heated at a temperature (T2) not higher than MFT1 and higher than MFT2 as shown in Expression (1-2) and are fixed to the recording medium. This can increase the glossiness in an area where the second liquid composition aggregated layer is present on the surface of the recorded image. Then, while the contact state of the second fixing unit and the recording medium is maintained, the temperature (T3) of the first and second liquid composition aggregated layers is reduced to a temperature not higher than MFT2 as shown in Expression (1-2). Then, the recording medium is separated (released) from the second fixing unit, and thus the high glossiness obtained by the second fixation step can be maintained in an area of the second liquid composition aggregated layer. In an area where the first liquid composition aggregated layer is present on the surface of the recorded image, low glossiness is maintained, and consequently various image patterns of high gloss and low gloss can be produced in a recorded image.

In other words, in the ink jet recording method of the present invention, the first and second liquid composition aggregated layers satisfy Expression (1-1), and the temperatures of the first and second liquid composition aggregated layers satisfy Expression (1-2) in the first and second fixation steps.

$$MFT1>MFT2 \quad (1\text{-}1)$$

$$T1>MFT1\geq T2>MFT2\geq T3 \quad (1\text{-}2)$$

T1: Temperature of the first liquid composition aggregated layer and the second liquid composition aggregated layer on a recording medium upon the heating and pressurization in the first fixation step T2: Temperature of the first liquid composition aggregated layer and the second liquid composition aggregated layer on the recording medium upon the heating and pressurization in the second fixation step T3: Temperature of the first liquid composition aggregated layer and the second liquid composition aggregated layer on the recording medium upon the separation in the second fixation step MFT1: Minimum film forming temperature of the first liquid composition aggregated layer MFT2: Minimum film forming temperature of the second liquid composition aggregated layer Basic Constitution of the Invention Next, the basic constitution of the direct drawing type ink jet recording method in an embodiment of the present invention will be described in detail.

Reaction Liquid

A reaction liquid in the present invention contains a viscosity increasing component for liquid compositions. The liquid composition-viscosity increasing typically means the case in which a coloring material, a resin, or the like as a component constituting liquid compositions chemically reacts or physically adsorbs upon contact with a viscosity increasing component for liquid compositions, and accordingly a viscosity increase of the whole of liquid compositions is observed. In addition to this case, the case in which some component of liquid compositions, such as a coloring material, aggregates to locally cause a viscosity increase. The viscosity increasing component has an effect of reducing the flowability of a liquid composition and/or some components of a liquid composition on a recording medium and of suppressing bleeding or beading at the time of image formation. In the embodiment of the present invention, conventionally known materials such as polyvalent metal ions, organic acids, cation polymers, and porous microparticles can be used as the viscosity increasing component for liquid compositions without any limitation. Specifically preferred are polyvalent metal ions and organic acids. Plural types of viscosity increasing component for liquid compositions are also preferably contained.

The content of the viscosity increasing component for liquid compositions in the reaction liquid is preferably 5% by mass or more relative to the total mass of the reaction liquid.

Examples of the metal ion specifically usable as the viscosity increasing component for liquid compositions include divalent metal ions such as $Ca^{2+}$, $Cu^{2+}$, $Ni^{2+}$, $Mg^{2+}$, $Sr^{2+}$, $Ba^{2+}$, and $Zn^{2+}$ and trivalent metal ions such as $Fe^{3+}$, $Cr^{3+}$, $Y^{3+}$, and $Al^{3+}$.

Examples of the organic acid specifically usable as the viscosity increasing component for liquid compositions include oxalic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, oxysuccinic acid, and dioxysuccinic acid.

The reaction liquid of the present invention may contain an appropriate amount of water and organic solvents. The water used in this case is preferably deionized water prepared by ion exchange, for example. The organic solvent usable in the reaction liquid of the present invention is not limited to particular solvents, and any known organic solvent can be used.

Into the reaction liquid of the present invention, various resins can be added. The addition of an appropriate resin enables an increase in the mechanical strength of a final image, and thus is preferred. The material to be used may be any material that can coexist with the viscosity increasing component for liquid compositions. To the reaction liquid, a surfactant or a viscosity modifier can be added to appropriately adjust the surface tension or the viscosity of the reaction liquid, and such a reaction liquid can be used. The material to be used may be any material that can coexist with the viscosity increasing component for liquid compositions. The surfactant specifically used is exemplified by "Acetylenol E 100" (trade name, manufactured by Kawaken Fine Chemicals Co.).

Application of Reaction Liquid

As for the method of applying the reaction liquid to the surface of a recording medium, various known techniques can be appropriately used. Examples of the technique include die coating, blade coating, techniques using gravure rollers, techniques using offset rollers, and spray coating. The application method of using an ink jet recording head is also preferred. A combination of a plurality of methods is also particularly preferred.

Image Formation

Subsequently, to the surface of a recording medium to which the reaction liquid is applied, first and second liquid compositions are applied by using ink jet recording heads, thereby forming an image.

The ink jet recording head applicable in the present invention is exemplified by a device that includes an electrothermal converter for causing film boiling of a liquid composition to form bubbles, thereby ejecting the liquid composition, a device that ejects a liquid composition by an electromechanical converter, and a device that ejects a liquid composition by using static electricity. Any of various ink jet recording heads applicable to the ink jet liquid ejection technique can be used. Of them, the device using an electrothermal converter can be suitably used from the viewpoint of particularly high-density printing at high speed.

The whole shape of the ink jet recording head is not limited to particular shapes, and the following ink jet recording heads can be used: what is called a shuttle type that performs recording while a head is scanned in a direction orthogonal to the moving direction of a recording medium; and what is called a line-head type in which ink ejection orifices are arranged in a linear manner substantially orthogonal to the moving direction of a recording medium. In addition, the recording system is not limited. For a shuttle type ink jet recording head, a multipath recording system in which scanning is performed twice or more to the same recording position may be employed, or a one-pass recording system in which scanning is performed only once to the same recording position may be employed. A method of recording an image in such a way that the image is divided into a plurality of mask patterns can also be employed.

Liquid Composition

The liquid composition used in the present invention contains at least a resin. As the minimum film forming temperature of a resin solid component in a liquid composition mentioned in the present invention, a value determined in accordance with Japanese Industrial Standards JIS K 6828-2 is used. When a film formation state cannot be clearly observed due to the effect of a coloring material, a liquid composition is prepared in accordance with a formulation in which the coloring material of components contained in the liquid composition is replaced with pure water, and the value determined by using such a liquid composition can be used. Alternatively, a liquid composition aggregated layer formed on a recording medium is heated, and the temperature at which the liquid composition aggregated layer is deformed can be determined as an approximate minimum film forming temperature.

Figure 2A:
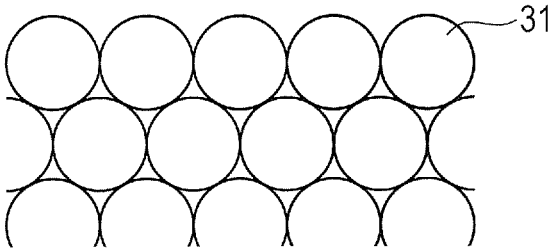
FIGS. 2A, 2B and 2C are enlarged schematic cross sectional views of a surface portion of a liquid composition aggregated layer in an embodiment of the present invention.
Figure 2B:
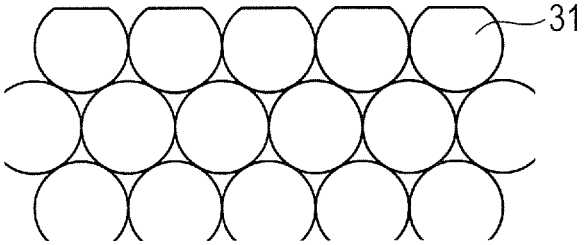
Figure 2C:
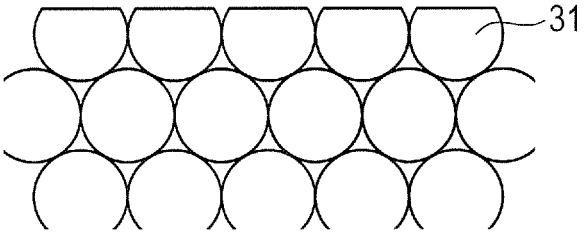

When the type or the formulation of materials contained in the liquid composition is changed, the glossiness of the liquid composition aggregated layer is changed. More specifically, the glossiness varies with a change in the refractive index of a material or a change in the deformation degree upon fixation due to the change in the minimum film forming temperature of a resin solid component in the liquid composition. It is thus preferred to select materials depending on an intended glossiness. FIGS. 2A to 2C are enlarged schematic cross sectional views of a surface portion of a liquid composition containing resin particles 31. The circles in FIGS. 2A to 2C represent the resin particles 31. FIG. 2A represents the shape of a surface portion after application of a liquid composition. When a liquid composition containing resin particles 31 is used, the resin particles 31 are exposed onto the liquid composition surface to give an uneven shape. FIG. 2B represents the surface shape of a liquid composition after fixation when the liquid composition contains a solid component having a high minimum film forming temperature. The resin particles 31 are unlikely to be deformed, and the uneven shape still remains. In contrast, FIG. 2C represents the surface shape of a liquid composition after fixation when the liquid composition contains a solid component having a low minimum film forming temperature. The resin particles 31 are likely to be deformed, and larger smooth areas are observed on the surface. As described above, the surface smoothness of a liquid composition after fixation varies with the minimum film forming temperature of a solid component in the liquid composition. Consequently, the glossiness of a printed material can be changed.

In the present invention, the minimum film forming temperature (MFT1) of the first liquid composition aggregated layer is lower than the temperature (T1) of the first and second liquid composition aggregated layers on the recording medium upon the heating and pressurization with the first fixing unit and is not lower than the temperature (T2) of the first and second liquid composition aggregated layers on the recording medium upon the heating and pressurization with the second fixing unit. The minimum film forming temperature (MFT2) of the second liquid composition aggregated layer is lower than the temperature (T2) and is not lower than the temperature (T3) of the liquid composition aggregated layers upon the separation of the recording medium from the second fixing unit. T1 is preferably 5° C. or more higher than MFT1 and more preferably 10° C. or more higher than MFT1. T2 is preferably 5° C. or more higher than MFT2 and more preferably 10° C. or more higher than MFT2. T2 is preferably 10° C. or more lower than MFT1 and more preferably 20° C. or more lower than MFT1. T3 is preferably 10° C. or more lower than MFT2 and more preferably 20° C. or more lower than MFT2. MFT2 is desirably not lower than such a temperature that the glossiness is not changed even when an image is touched by a finger or the like, and is preferably 50° C. or more and more preferably 70° C. or more. T1 may be any temperature as long as an image to be formed is not affected, and is typically, preferably 200° C. or less in order not to increase energy for heating, for example. More preferably, the temperature of the heating roller described later is 200° C. or less.

Components Contained in First and Second Liquid Compositions

Next, each component usable in the first and second liquid compositions in the present invention will be described.

Coloring Material

In the liquid composition in the present invention, a coloring material in which a known dye, carbon black, an organic pigment, or the like is dissolved and/or dispersed can be used. Specifically, various pigments, which are characterized by achieving durability and quality of printed materials, are preferred.

Pigment

The pigment usable in the present invention is not limited to particular pigments, and known inorganic pigments and organic pigments can be used. Specifically, pigments indicated by color index (C.I.) numbers can be used. As the black pigment, carbon black is also preferably used. The content of the pigment in the liquid composition is preferably 15.0% by mass or less and more preferably 10.0% by mass or less relative to the total mass of the liquid composition.

Pigment Dispersant

As for the dispersant for dispersing a pigment, any dispersant that has been used in known ink jet inks can be used. Specifically, a water-soluble dispersant having both a hydrophilic moiety and a hydrophobic moiety in the structure is preferably used in the embodiment of the present invention. In particular, a pigment dispersant composed of a resin prepared by copolymerizing a mixture containing at least a hydrophilic monomer and a hydrophobic monomer is preferably used. Each monomer used here is not limited to particular monomers, and known monomers are suitably used. Specifically, examples of the hydrophobic monomer include styrene, styrene derivatives, alkyl (meth)acrylates, and benzyl (meth)acrylate. Examples of the hydrophilic monomer include acrylic acid, methacrylic acid, and maleic acid.

What is called a self-dispersible pigment that is dispersible due to surface modification of a pigment itself and eliminates the use of the dispersant is also preferably used in the present invention.

Resin Particles

The liquid composition in the present invention can contain various particles having no coloring material, and such a liquid composition can be used. Of them, resin particles may have the effect of improving image quality or fixability and thus are preferred.

The material of the resin particles usable in the present invention is not limited to particular materials, and known resins can be appropriately used. The material is specifically exemplified by homopolymers such as polyolefin, polystyrene, polyurethane, polyester, polyether, polyurea, polyamide, polyvinyl alcohol, poly(meth)acrylic acid and salts thereof, polyalkyl (meth)acrylates, and polydienes; and copolymers prepared by copolymerizing a plurality of monomers of them in combination.

In the embodiment of the present invention, the resin particles are preferably used as a resin particle dispersion in which the resin particles are dispersed in a liquid. The dispersion technique is not limited to particular techniques. Preferred is what is called a self-dispersion type resin particle dispersion in which a resin prepared by homopolymerization of a monomer having a dissociable group or by copolymerization of a plurality of such monomers is dispersed. The dissociable group is exemplified by a carboxyl group, a sulfonic acid group, and a phosphoric acid group, and the monomer having such a dissociable group is exemplified by acrylic acid and methacrylic acid. In addition, what is called an emulsion-dispersion type resin particle dispersion in which resin particles are dispersed with an emulsifier can be similarly, suitably used in the present invention. As the emulsifier as used herein, any known surfactant having a low molecular weight or a high molecular weight is suitably used. The surfactant is preferably a nonionic surfactant or a surfactant having the same charge as that of resin particles.

The resin particles preferably have a volume average particle diameter of 10 to 1,000 nm, but the volume average particle diameter can be changed depending on intended gloss.

When the resin particle dispersion used in the embodiment of the present invention is prepared, various additives are preferably added for stabilization. The additives are preferably n-hexadecane, dodecyl methacrylate, stearyl methacrylate, chlorobenzene, dodecyl mercaptan, and methyl methacrylate, for example.

The polymer compound used in the present invention may be a water-soluble resin.

Surfactant

The liquid composition usable in the present invention may contain a surfactant. As the surfactant, a commercially available surfactant can be suitably used, and "Acetylenol EH" (trade name, manufactured by Kawaken Fine Chemicals Co.) is specifically exemplified.

Water and Water-Soluble Organic Solvent

The liquid composition used in the present invention can contain water and/or a water-soluble organic solvent as the solvent. The water is preferably deionized water prepared by ion exchange, for example. The type of the water-soluble organic solvent to be used is not limited to those of particular types, and any known organic solvent can be used. The water-soluble organic solvent is specifically exemplified by glycerol, diethylene glycol, polyethylene glycol, and 2-pyrrolidone.

Other Additives

The liquid composition usable in the present invention may contain various additives such as pH adjusters, anticorrosives, antiseptic agents, antifungal agents, antioxidants, reduction inhibitors, water-soluble resins and neutralizers thereof, and viscosity modifiers, in addition to the above components as necessary.

Removal of Water

In the embodiment of the present invention, a step of reducing a liquid content from the recorded image formed by ink jet recording heads is preferably provided. An excess liquid content in the recorded image may cause image deterioration phenomena such as feathering in which inks spread along fibers of a recording medium.

As the technique of removing water, any of various techniques commonly used can be suitably used. Any of a heating method, a method of sending low-humidity air, a decompression method, and a combination method of them can be suitably used. Water can also be removed by air drying.

Fixation

The recording medium on which an image is recorded can be subjected to heating and pressurization with a roller to improve the fixability between the recording medium and the image. A heating roller is more preferably used. The typical fixing systems using a heating roller include a roller nip system and an endless press system, and both are preferably used. Each system will be next described in detail with reference to FIG. 3 and FIG. 4.

Roller Nip System

Figure 3:
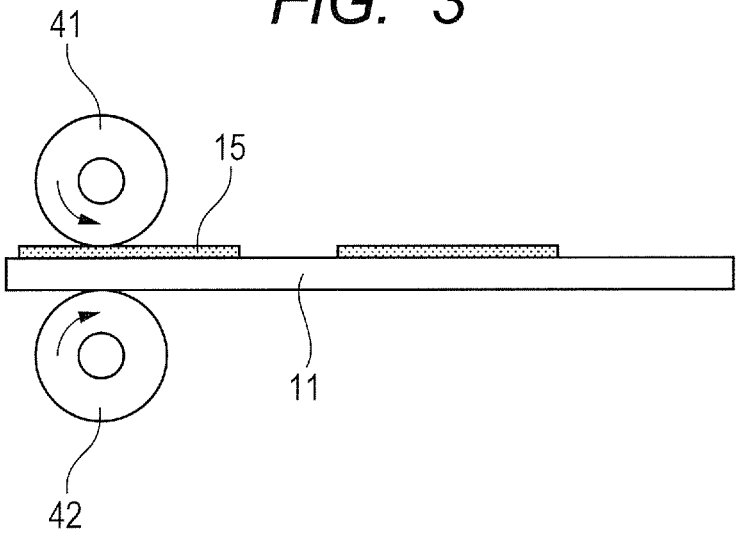
FIG. 3 is a schematic view of a roll nip type pressurization heating unit in an embodiment of the present invention.

Here, a roller nip system, which is a heating and pressurization fixation system, will be described with reference to FIG. 3. As shown in FIG. 3, the roller nip system is a system in which a heating roller 41 and a support roller 42 are in contact, and a liquid composition aggregated layer 15 formed on a recording medium 11 passes between these two rollers. Heat applied with the heating roller 41 to the liquid composition aggregated layer 15 softens the liquid composition aggregated layer 15, and pressurization smoothes the liquid composition aggregated layer 15. Here, the surface of the heating roller 41 is required to be at least smoother than an intended smoothness of a recorded image. In addition, the liquid composition aggregated layer 15 is separated (released) from the heating roller 41 while being heated, and thus a material having good releasability between the heating roller 41 and the liquid composition aggregated layer 15 is preferably selected as the surface base material of the heating roller 41. As the surface base material of the heating roller 41, fluorine resins such as PTFE and PFA are preferred, for example.

Endless Press System

Figure 4:
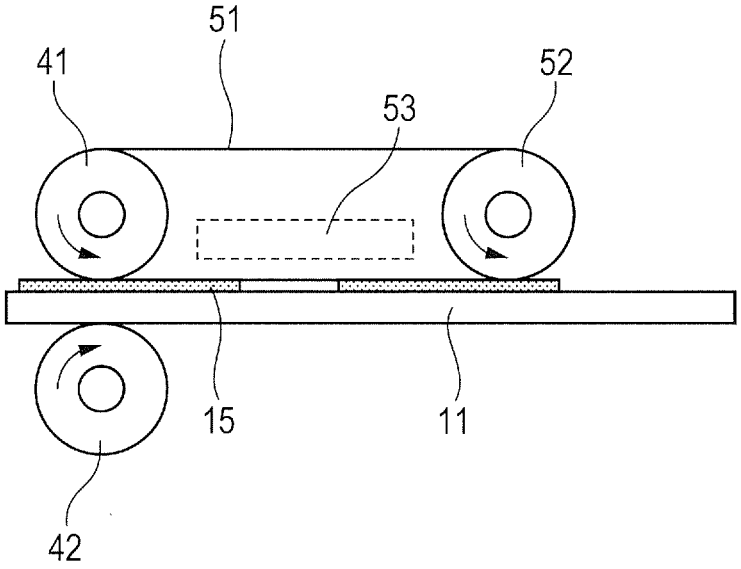
FIG. 4 is a schematic view of an endless press type pressurization heating unit in an embodiment of the present invention.

Next, an endless press system, which is a heating and pressurization fixation system, will be described with reference to FIG. 4. A fixing belt 51 rolled on a heating roller 41 and a support roller 42 are in contact, and a liquid composition aggregated layer 15 formed on a recording medium 11 passes between these two rollers. The fixing belt 51 is rolled on the heating roller 41 and a separation roller 52, and the fixing belt 51 is in contact with the liquid composition aggregated layer 15 formed on the recording medium 11 until the recording medium arrives at the position of the separation roller 52. Between the heating roller 41 and the separation roller 52, a cooler 53 is provided. The liquid composition aggregated layer 15 is cooled when the recording medium 11 arrives at the position of the separation roller 52, and thus the fixing belt 51 and the liquid composition aggregated layer 15 can be separated at a low temperature. As the surface base material of the fixing belt 51, polyimide is preferred, for example. The fixation system is preferably used in the second fixation step.

[2] Transfer Type Ink Jet Recording Method

Another embodiment of the present invention includes a step of forming a first liquid composition aggregated layer on an intermediate transfer member and a step of forming a second liquid composition aggregated layer. Through these steps, an intermediate image is formed on the intermediate transfer member. This embodiment further includes a transfer step of transferring the first liquid composition aggregated layer and the second liquid composition aggregated layer on the intermediate transfer member to a recording medium and a first fixation step and a second fixation step of performing heating and pressurization of the first liquid composition aggregated layer and the second liquid composition aggregated layer formed on the recording medium to fix them onto the recording medium. Here, the transfer step and the first fixation step can be concurrently performed as a single step.

In the step of forming a first liquid composition aggregated layer, a first liquid composition containing a resin is applied to an intermediate transfer member by using an ink jet recording head to form a first liquid composition aggregated layer. The step of forming a first liquid composition aggregated layer may include a step of applying a reaction liquid that causes aggregation of components such as a coloring material in the first liquid composition, onto an intermediate transfer member and a step of applying a first liquid composition onto the intermediate transfer member.

In the step of forming a second liquid composition aggregated layer, a second liquid composition containing a resin is applied to the intermediate transfer member by using an ink jet recording head to form a second liquid composition aggregated layer. The step may include a step of removing water by air blowing or the like. The second liquid composition is preferably applied to an area that at least partly overlaps with an area where the first liquid composition aggregated layer is formed, but no overlap area may be provided.

The order of performing the step of forming a first liquid composition aggregated layer and the step of forming a second liquid composition aggregated layer is not limited to particular orders.

The transfer step is a step of pressing a recording medium against the intermediate transfer member on which the intermediate image composed of the first and second liquid composition aggregated layers is formed and transferring the first and second liquid composition aggregated layers to the recording medium.

Here, the first and second liquid composition aggregated layers satisfy Expression (2-1).

$$MFT1>MFT2 \quad (2\text{-}1)$$

MFT1: Minimum film forming temperature of the first liquid composition aggregated layer MFT2: Minimum film forming temperature of the second liquid composition aggregated layer In the transfer step, the intermediate transfer member can be heated before transfer to increase the temperature of the liquid composition aggregated layers on the intermediate transfer member. Alternatively, a two-step transfer method in which the liquid composition aggregated layers are transferred from the intermediate transfer member to another intermediate transfer member at high temperature to increase the temperature of the liquid composition aggregated layers on the intermediate transfer member may be adopted. When the liquid composition aggregated layers are made to have a high temperature and transferred to a recording medium, the transfer step and the first fixation step can be concurrently performed as a single step by heating the liquid composition aggregated layers to a temperature (T1) higher than the minimum film forming temperature (MFT1) of the first liquid composition aggregated layer and higher than the minimum film forming temperature (MFT2) of the second liquid composition aggregated layer as shown in Expression (2-2). When the liquid composition aggregated layers are pressed against a recording medium with a pressure bonding member while being heated at a temperature higher than MFT1 and MFT2 to be transferred and pressurized, a recorded image having scratch resistance is formed. The transfer step and the first fixation step may be performed separately. In such a case, the liquid composition aggregated layers can be heated as described above to be fixed with another unit for performing heating and pressurization of a recording medium (first fixing unit), separately from the heating and pressurization unit in the transfer step.

In the first fixation step using the first fixing unit, the first and second liquid composition aggregated layers are heated with the first fixing unit to a temperature (T1) higher than MFT1 and MFT2 as shown in Expression (2-2) and thus are fixed to the recording medium. When the transfer step and the first fixation step are concurrently performed, the heating and pressurization by the first fixing unit is eliminated.

After the first fixation step, the first and second liquid composition aggregated layers on the recording medium are released from the heating and pressurization by the intermediate transfer member or the first fixing unit and are conveyed to a second fixing unit in a second fixation step. During the conveyance, the first and second liquid composition aggregated layers are preferably cooled to a temperature not higher than MFT1. These layers may be cooled to a temperature not higher than MFT2. For the cooling, another unit for cooling may be provided, but for a simple and easy method, a certain distance is provided in such a way as to naturally cool the layers from the first fixation step until contact of the layers with the second fixing unit in the second fixation step.

Subsequent to the first fixation step, the recording medium subjected to the first fixation step is subjected to heating and pressurization once again by using the second fixing unit in the second fixation step. The minimum film forming temperature (MFT1) of the first liquid composition aggregated layer and the minimum film forming temperature (MFT2) of the second liquid composition aggregated layer have the relation MFT1>MFT2 as shown in Expression (2-1). In the second fixation step, the layers are heated to a temperature (T2) not higher than MFT1 and higher than MFT2 as shown in Expression (2-2) to be fixed to the recording medium. This can increase the gloss in an area where the second liquid composition aggregated layer is present on the surface of the recorded image. Then, while the contact of the recording medium and the second fixing unit is maintained, the temperature (T3) of the first and second liquid composition aggregated layers is reduced to a temperature not higher than MFT2 as shown in Expression (2-2). Then, the recording medium is separated (released) from the second fixing unit, and thus the high glossiness obtained by the second fixation step can be maintained in an area where the second liquid composition aggregated layer is present. In an area where the first liquid composition aggregated layer is present on the surface of the recorded image, the low glossiness is maintained, and consequently various image patterns of high gloss and low gloss can be produced in a recorded image.

In other words, in the ink jet recording method of the present invention, the first and second liquid composition aggregated layers satisfy Expression (2-1), and the temperatures of the first and second liquid composition aggregated layers in the first and second fixation steps satisfy Expression (2-2).

$$MFT1>MFT2 \quad (2\text{-}1)$$

$$T1>MFT1\geq T2>MFT2\geq T3 \quad (2\text{-}2)$$

T1: Temperature of the first liquid composition aggregated layer and the second liquid composition aggregated layer on a recording medium upon the heating and pressurization in the first fixation step T2: Temperature of the first liquid composition aggregated layer and the second liquid composition aggregated layer on the recording medium upon the heating and pressurization in the second fixation step T3: Temperature of the first liquid composition aggregated layer and the second liquid composition aggregated layer on the recording medium upon the separation in the second fixation step MFT1: Minimum film forming temperature of the first liquid composition aggregated layer MFT2: Minimum film forming temperature of the second liquid composition aggregated layer Basic Constitution of the Invention Next, the basic constitution of the transfer type ink jet recording method in an embodiment of the present invention will be described in detail.

Intermediate Transfer Member

The intermediate transfer member in the present invention is a base material which holds a reaction liquid and liquid compositions to form an intermediate image. The structure of the intermediate transfer member includes a support member for handling the intermediate transfer member and for conveying a required force and a surface layer member for forming an image. These members may be formed from a uniform member or each may be formed from a plurality of independent members.

The shape of the intermediate transfer member is exemplified by a sheet shape, a roller shape, a drum shape, a belt shape, and an endless web shape. When a drum-shaped support member or a belt-shaped endless-web type support member is used, the same intermediate transfer member can be continuously, repeatedly used, and thus such a structure is particularly preferred in terms of productivity. The size of the intermediate transfer member can be freely selected in accordance with an intended print image size.

The support member of the intermediate transfer member is required to have a certain structural strength from the viewpoint of the transfer accuracy and the durability thereof. The material is preferably metals, ceramics, and resins, for example. Specifically, aluminum, iron, stainless steel, acetal resins, epoxy resins, polyimide, polyethylene, polyethylene terephthalate, nylon, polyurethane, silica ceramics, alumina ceramics, and the like are used in terms of the rigidity capable of withstanding the pressure at the time of transfer, dimensional accuracy, and characteristics required to reduce the inertia during operation to improve the control responsivity. These materials can be used in combination.

The surface layer member of the intermediate transfer member preferably has a certain elasticity in order to perform pressure bonding of an image to a recording medium such as paper and to transfer the image. When paper is used as the recording medium, the hardness of the surface layer member of the intermediate transfer member is preferably a durometer A hardness of 10° to 100° and more preferably 20° to 60° (in accordance with JIS K6253). As the material of the surface layer member, various materials such as polymers, ceramics, and metals can be appropriately used, and various rubber materials and elastomer materials are preferably used in terms of the above-mentioned characteristics and process characteristics. For example, preferred are polybutadiene rubbers, nitrile rubbers, chloroprene rubbers, silicone rubbers, fluororubbers, urethane rubbers, styrene elastomers, olefin elastomers, polyvinyl chloride elastomers, ester elastomers, and amide elastomers. In addition, polyether, polyester, polystyrene, polycarbonate, siloxane compounds, and perfluorocarbon compounds can also be suitably used, for example.

Specifically, nitrile-butadiene rubber, silicone rubber, fluororubber, and urethane rubber are particularly preferably used in terms of dimensional stability, durability, heat resistance, and the like.

As the surface layer member, a member prepared by laminating a plurality of materials is also preferred. For example, a member prepared by covering an endless belt-shaped urethane rubber with silicone rubber, a sheet prepared by laminating silicone rubber on a PET film, and a laminated material prepared by forming a polysiloxane compound film on a urethane rubber sheet are suitably used. A sheet prepared by infiltrating a rubber material such as nitrile-butadiene rubber and urethane rubber into a cotton fabric or a woven fabric such as polyester fabric and rayon fabric as a base fabric can also be suitably used.

The surface layer member may be subjected to an appropriate surface treatment. Examples of the treatment include flame treatment, corona treatment, plasma treatment, polishing treatment, roughening treatment, active energy ray (UV, IR, RF, for example) irradiation treatment, ozone treatment, surfactant treatment, and silane coupling treatment. These treatments are also preferably performed in combination.

Between the surface layer member and the support member, various adhesives, double-sided adhesive tapes, and the like may be applied in order to fix and hold these members.

Reaction Liquid and Application of Reaction Liquid

The reaction liquid used in the transfer type ink jet recording method of the present invention may be the same as the reaction liquid used in the above direct drawing type ink jet recording method. As for the application method of the reaction liquid, the same application method of a reaction liquid as in the direct drawing type ink jet recording method can be used except that the reaction liquid is applied to an intermediate transfer member in place of a recording medium.

Image Formation

Next, to the surface of an intermediate transfer member to which the reaction liquid is applied, first and second liquid compositions are applied by using ink jet recording heads to form an image. The order of applying the first and second liquid compositions is not limited to particular orders, but it is preferred to form a transfer image in such a way that the liquid composition aggregated layer containing no coloring material becomes the upper layer in a recorded image to be transferred to a recording medium.

In this step, liquid compositions are applied with ink jet devices onto the intermediate transfer member on which the reaction liquid has been applied in response to image signals generated in an image data generation step, forming an intermediate image.

The ink jet recording head applicable in the present invention is exemplified by a device that includes an electrothermal converter for causing film boiling of a liquid composition to form bubbles and ejects the liquid composition, a device that ejects a liquid composition by an electromechanical converter, and a device that ejects a liquid composition by using static electricity. Any of various ink jet recording heads applicable to the ink jet liquid ejection technique can be used. Of them, the device using an electrothermal converter is suitably used from the viewpoint of particularly high-density printing at high speed.

The whole configuration of the ink jet recording head is not limited to particular shapes, and the following ink jet recording heads can be used: what is called a shuttle type that performs recording while a head is scanned in a direction orthogonal to the moving direction of an intermediate transfer member; and what is called a line-head type in which ink ejection orifices are arranged in a linear manner substantially orthogonal to the moving direction of an intermediate transfer member. In addition, the recording system is not limited. For a shuttle type ink jet recording head, a multipath recording system in which scanning is performed twice or more to the same recording position for recording may be employed, or a one-pass recording system in which scanning is performed only once to the same recording position for recording may be employed. A method of recording an image in such a way that the image is divided into a plurality of mask patterns can also be employed.

Liquid Composition

The liquid composition used in the transfer type ink jet recording method of the present invention contains at least a resin. As the minimum film forming temperature of a resin solid component in a liquid composition mentioned in the present invention, a value determined in accordance with Japanese Industrial Standards, JIS K 6828-2 is used. When a film-forming state cannot be clearly observed due to the effect of a coloring material, a liquid composition is prepared in accordance with a formulation in which the coloring material of components contained in the liquid composition is replaced with pure water, and the value determined by using such a liquid composition can be used. Alternatively, a liquid composition aggregated layer formed on a recording medium is heated, and the temperature at which the liquid composition aggregated layer is deformed can be determined as an approximate minimum film forming temperature.

As the type or the formulation of materials contained in the liquid composition are changed, the glossiness is changed. The principle of changing glossiness is as described above with reference to FIGS. 2A to 2C.

In the present invention, the minimum film forming temperature (MFT1) of the first liquid composition aggregated layer is lower than the temperature (T1) of the first and second liquid composition aggregated layers upon the heating and pressurization in the first fixation step and is not lower than the temperature (T2) of the first and second liquid composition aggregated layers upon the heating and pressurization in the second fixation step. The minimum film forming temperature (MFT2) of the second liquid composition aggregated layer is lower than the temperature (T2) of the first and second liquid composition aggregated layers upon the heating and pressurization in the second fixation step and is not lower than the temperature (T3) of the first and second liquid composition aggregated layers upon the separation of the recording medium from the second fixing unit in the second fixation step.

In other words, the relation of Expression (2-2) is satisfied.

$$T1>MFT1\geq T2>MFT2\geq T3 \quad (2\text{-}2)$$

T1: Temperature of the first liquid composition aggregated layer and the second liquid composition aggregated layer on a recording medium upon the heating and pressurization in the first fixation step T2: Temperature of the first liquid composition aggregated layer and the second liquid composition aggregated layer on the recording medium upon the heating and pressurization in the second fixation step T3: Temperature of the first liquid composition aggregated layer and the second liquid composition aggregated layer on the recording medium upon the separation in the second fixation step Here, T1 is preferably 5° C. or more higher than MFT1 and more preferably 10° C. or more higher than MFT1. T2 is preferably 5° C. or more higher than MFT2 and more preferably 10° C. or more higher than MFT2. T2 is preferably 10° C. or more lower than MFT1 and more preferably 20° C. or more lower than MFT1. T3 is preferably 10° C. or more lower than MFT2 and more preferably 20° C. or more lower than MFT2. MFT2 is desirably not lower than such a temperature that the glossiness is not changed even when an image is touched by a finger or the like, and is preferably 50° C. or more and more preferably 70° C. or more. T1 may be any temperature as long as an image to be formed is not affected, and is typically, preferably 200° C. or less in order not to increase an energy for heating, for example. More preferably, the temperature of the heating roller described later is 200° C. or less.

Components Contained in First and Second Liquid Compositions

The components usable in the first and second liquid compositions in the transfer type ink jet recording method of the present invention (coloring material, pigment, pigment dispersant, resin particles, surfactant, water, water-soluble organic solvent, additional additives, for example) are the same as the components usable in the first and second liquid compositions used in the above-mentioned direct drawing type ink jet recording method.

Removal of Liquid

In the embodiment of the present invention, a step of reducing a liquid content from the intermediate image formed by ink jet recording heads is preferably provided. An excess liquid content in the intermediate image may cause deterioration of an intermediate image during rotation of an intermediate transfer member or cause image deterioration phenomena such as feathering in which inks spread along fibers of a recording medium.

As the liquid removal technique, any of various techniques commonly used can be suitably used. Any of a heating method, a method of sending low-humidity air, a decompression method, and a combination method of them can be suitably used. Liquid can also be removed by air drying.

Transfer

The technique of performing pressure bonding of an intermediate transfer member to a recording medium is not limited to particular techniques. When a heating roller is used as a pressure bonding member to perform pressurization from both the intermediate transfer member side and the recording medium side, the liquid composition aggregated layers are efficiency transferred, and thus such a technique is preferred. Pressurization through multiple steps may have an effect of suppressing defective transfer and is also preferred.

In the heating roller, a heater is preferably provided inside the roller in order to control the temperature at the time of transfer. The heater may be arranged at a part of the roller but is preferably arranged all over the roller. The transfer is performed at any temperature in accordance with the type of a liquid composition used, and thus the heater is preferably capable of variously heating the heating roller in such a way as to give a surface temperature of 25° C. to 200° C.

When a two-step transfer system is adopted, a first intermediate transfer member on which an intermediate image is formed is subjected to pressurization from both the first intermediate transfer member side and a second intermediate transfer member side by using a heating roller, and consequently the liquid composition aggregated layers can be transferred. When the second intermediate transfer member has a larger adhesion force to liquid composition aggregated layers and a higher transfer member temperature than those of the first intermediate transfer member, and the second intermediate transfer member has a smaller surface hardness than that of the first intermediate transfer member, liquid composition aggregated layers are efficiency transferred, and thus such conditions are preferred.

For the transfer from the second intermediate transfer member to a recording medium, the same transfer technique from an intermediate transfer member to a recording medium as the above is adopted.

Fixation

The recording medium on which an image is recorded can be subjected to heating and pressurization with a roller to improve the fixability between the recording medium and the image. A heating roller is more preferably used. A typical fixation system using the heating roller is the same as the fixation system in the above-mentioned direct drawing type ink jet recording method.

EXAMPLES

The present invention will next be described in further detail with reference to examples of the ink jet recording method of the present invention. The present invention is not intended to be limited to the following examples without departing from the scope of the invention. In the following description, "part" and "%" are based on mass unless otherwise noted. In examples of the present invention, mirror-coated paper (basis weight of 127.9 g/m$^2$) was used as the recording medium. Cast-coated papers such as the mirror-coated paper have higher whiteness, higher smoothness, and higher glossiness than those of gloss-coated paper. In the present structure, a line-head type ink jet recording head was used to form an image on a recording medium of 60° C. with a reaction liquid coating amount of 1 g/m$^2$ and a recording dot resolution of 1,200 dpi. In the ink jet recording head, devices each including a thermoelectric conversion element and ejecting an ink on demand in an ejection amount of 3 pl were arranged in a linear manner substantially orthogonal to the moving direction of a recording medium. At this time, the total application amount of liquid compositions is 20 g/cm$^2$.

Example 1-1

Preparation of Reaction Liquid

The reaction liquid used in the present invention was prepared as follows: components were mixed in accordance with the following formulation and thoroughly stirred; and then the mixture was subjected to pressure filtration through a microfilter with a pore size of 3.0 (manufactured by Fujifilm Corporation), giving the reaction liquid.

Glycerol 20.0%

Calcium chloride tetrahydrate 16.0%

Surfactant 1 (trade name "Acetylenol EH", manufactured by Kawaken Fine Chemicals Co.) 1.0%

Pure water 63.0%

The liquid compositions used in the example were prepared by the following procedure.

Preparation of Black Pigment Dispersion Liquid

First, 10% of carbon black (product name: Monarch 1100, manufactured by Cabot Corporation), 15% of an aqueous solution of a pigment dispersant (a styrene-ethyl acrylate-acrylic acid copolymer with an acid value of 150 and a weight average molecular weight of 8,000; solid content of 20%; neutralized with potassium hydroxide), and 75% of pure water were mixed. The mixture was placed in a batch type vertical sand mill (manufactured by Aimex Co.), and 200% of 0.3-mm zirconia beads were placed. The mixture was dispersed for 5 hours while being cooled with water. The dispersion liquid was subjected to a centrifuge separator to remove coarse particles, giving a black pigment dispersion liquid having a pigment concentration of about 10%.

Preparation of Cyan Pigment Dispersion Liquid

A cyan pigment dispersion liquid was prepared in the same manner as in the preparation of a black pigment dispersion liquid except that 10% of carbon black used in the preparation of a black pigment dispersion liquid was replaced with 10% of C.I. Pigment Blue 15:3.

Preparation of Magenta Pigment Dispersion Liquid

A magenta pigment dispersion liquid was prepared in the same manner as in the preparation of a black pigment dispersion liquid except that 10% of carbon black used in the preparation of a black pigment dispersion liquid was replaced with 10% of C.I. Pigment Red 122.

Preparation of Yellow Pigment Dispersion Liquid

A yellow pigment dispersion liquid was prepared in the same manner as in the preparation of a black pigment dispersion liquid except that 10% of carbon black used in the preparation of a black pigment dispersion liquid was replaced with 10% of C.I. Pigment Yellow 74.

Preparation of Resin Particle Dispersion 1

First, 18% of butyl methacrylate, 2% of 2,2'-azobis-(2-methylbutyronitrile), and 2% of n-hexadecane were mixed and stirred for 0.5 hour. The mixture was added dropwise to 78% of a 6% aqueous solution of "NIKKOL BC15" (trade name, manufactured by Nikko Chemicals Co.) which is an emulsifier, and the resulting mixture was stirred for 0.5 hour. Next, the mixture was sonicated with a sonicator for 3 hours. Subsequently, the mixture was polymerized under a nitrogen atmosphere at 80° C. for 4 hours. The reaction mixture was cooled to room temperature and then filtered, giving a resin particle dispersion 1 having a concentration of about 20%. The resin particles had a mass average molecular weight of about 200,000 and a dispersion particle diameter of about 100 nm to 500 nm.

Preparation of Resin Particle Dispersion 2

A resin particle dispersion 2 was prepared in the same manner as in the preparation of a resin particle dispersion 1 except that 18% of butyl methacrylate used in the preparation of a resin particle dispersion 1 was replaced with 18% of ethyl methacrylate.

Preparation of Liquid Composition

In accordance with the following formulations, black, cyan, magenta, and yellow liquid compositions were prepared as the first liquid compositions, and a liquid composition containing no coloring material was prepared as the second liquid composition. Specifically, components were mixed in accordance with the following formulations and thoroughly stirred. The mixture was then subjected to pressure filtration through a microfilter with a pore size of 3.0 μm (manufactured by Fujifilm Corporation), giving a liquid composition.

Formulation of First Liquid Composition

Corresponding color pigment dispersion liquid (concentration of about 10%) 20%

Resin particle dispersion 1 (concentration of about 20%) 50%

Glycerol 5%

Diethylene glycol 7%

Surfactant 1 0.5%

Pure water 17.5%

Formulation of Second Liquid Composition

Resin particle dispersion 2 (concentration of about 20%) 50%

Glycerol 5%

Diethylene glycol 7%

Surfactant 1 0.5%

Pure water 37.5%

The principal part of the example will next be described in detail with reference to drawings.

Figure 5:
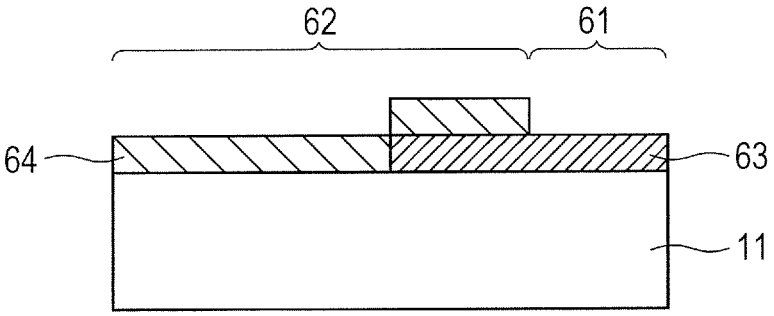
FIG. 5 is a schematic view of a layer structure of liquid composition aggregated layers in Example 1-1.

FIG. 1 is a schematic view of a direct drawing type ink jet printer for describing the direct drawing type ink jet recording method in an embodiment of the present invention. In FIG. 1, a reaction liquid 13 is first applied to a recording medium 11 by using a roller type coating apparatus 12. Next, when the recording medium 11 arrives at the position of an ink jet recording head 14, black, cyan, magenta, and yellow first liquid compositions are ejected from the ink jet recording head 14, and a second liquid composition is subsequently ejected. Each composition reacts with the reaction liquid 13 previously applied onto the recording medium 11. As shown in FIG. 5, a first liquid composition aggregated layer 61 composed of the first liquid composition 63 is formed, and a second liquid composition aggregated layer 62 composed of the second liquid composition 64 is formed on the recording medium 11. In this embodiment, a liquid composition aggregated layer composed of the first liquid composition having a high minimum film forming temperature is regarded as the first liquid composition aggregated layer, and a liquid composition aggregated layer composed of the second liquid composition having a low minimum film forming temperature is regarded as the second liquid composition aggregated layer. When the recording medium 11 arrives at an air blower 17, the water contained in the first liquid composition aggregated layer 61 and the second liquid composition aggregated layer 62 is removed by air blowing.

Next, when the recording medium 11 arrives at the position of a first fixing unit 18, the first liquid composition aggregated layer 61 and the second liquid composition aggregated layer 62 are fixed by heating and pressurization. In this example, a roller nip system shown in FIG. 3 was used as the first fixing unit 18. As the surface base material of a heating roller 41, silicone rubber was used. The temperature of the heating roller 41 was set at 180° C. so that the temperature of the first liquid composition aggregated layer 61 and the second liquid composition aggregated layer 62 upon the fixation was sufficiently higher than the minimum film forming temperatures (MFT) of the liquid compositions contained in the first liquid composition aggregated layer 61 and the second liquid composition aggregated layer 62, and the pressure for pressurization was set at 98 $N/cm^2$ (10 $kgf/cm^2$). The time of nipping between the heating roller 41 and a support roller 42 was set at 900 msec.

Table 1 shows the temperature of the first liquid composition aggregated layer 61 and the second liquid composition aggregated layer 62 at this fixation and the minimum film forming temperatures of the first liquid composition aggregated layer 61 and the second liquid composition aggregated layer 62. The temperature of the liquid composition aggregated layers upon the fixation was determined by measuring the temperature of the liquid composition aggregated layers on the recording medium 11 immediately after the fixation nipping with a noncontact thermometer (IT-314 manufactured by As One Corporation).

As shown in Table 1, the aggregated layer temperature (T1) of the first and second liquid composition aggregated layers 61 and 62 upon the fixation is higher than each minimum film forming temperature, and thus the first and second liquid composition aggregated layers undergo film formation and are fixed.

The first and second liquid composition aggregated layers on the recording medium 11 after passing the heating roller 41 have low glossiness. This is thought to be because the layers are separated from the heating roller 41 at a temperature higher than each minimum film forming temperature and thus the aggregated layers have an uneven surface shape due to, for example, a tacking force to the heating roller 41 upon the separation.

TABLE 1

Minimum film forming temperature of liquid composition aggregated layer and temperature upon fixation

| | First liquid composition aggregated layer | Second liquid composition aggregated layer |
|---|---|---|
| Temperature upon fixation ($T_1$) | 178° C. | 178° C. |
| Minimum film forming temperature | 160° C. | 120° C. |

Next, when the recording medium 11 arrives at the position of a second fixing unit 19, the first liquid composition aggregated layer 61 and the second liquid composition aggregated layer 62 are subjected to pressurization and heating. In the example, an endless press system shown in FIG. 4 was used as the second fixing unit 19. As the surface base material of a fixing belt 51, a smooth polyimide film ("Kapton" (registered trademark), manufactured by DU PONT-TORAY Co., Ltd.) was used. The temperature of a heating roller 41 was set at 140° C. so that the temperature of the first liquid composition aggregated layer 61 upon the fixation was sufficiently lower than the minimum film forming temperature of the first liquid composition aggregated layer 61 and was sufficiently higher than the minimum film forming temperature of the second liquid composition aggregated layer 62, and the pressure for pressurization was set at 98 $N/cm^2$ (10 $kgf/cm^2$). The time of nipping between the fixing belt 51 and a support roller 42 was set at 900 msec.

The temperature (T2) of the first and second liquid composition aggregated layers upon the heating and pressurization by the second fixing unit (upon the fixation) is sufficiently lower than the minimum film forming temperature of the first liquid composition aggregated layer 61. Accordingly, the surface of the first liquid composition aggregated layer 61 is not deformed by the fixing belt 51, and thus the uneven surface shape still remains. T2 is sufficiently higher than the minimum film forming temperature of the second liquid composition aggregated layer 62, and thus the surface of the second liquid composition aggregated layer 62 is supposed to be deformed into a smooth surface shape in accordance with the smooth surface of the fixing belt 51.

After the fixation nipping, the liquid composition aggregated layers are cooled while the contact of the fixing belt 51 and the liquid composition aggregated layers is maintained, and then the contact is terminated (the layers are separated) at a low temperature. When the temperature (T3) of the liquid composition aggregated layers upon the separation is lower than the minimum film forming temperature of the second liquid composition, the second liquid composition aggregated layer 62 has sufficient hardness, and thus the layers are separated while maintaining the smooth surface shape due to the smooth Kapton, giving high glossiness.

Table 2 shows the temperatures (T2) upon the fixation and the temperatures (T3) upon the separation of the first liquid composition aggregated layer 61 and the second liquid composition aggregated layer 62 in the second fixing unit, the minimum film forming temperatures of the first liquid composition aggregated layer 61 and the second liquid composition aggregated layer 62, and the 20-degree glossinesses of the first liquid composition aggregated layer 61 and the second liquid composition aggregated layer 62. The temperature of the liquid composition aggregated layers upon the fixation nipping was determined under such a condition that a temperature-indicating label (CR-D manufactured by MICRON Co.) was placed on the recording medium and the fixation was performed. The temperature of the liquid composition aggregated layers upon the fixation and separation was determined with a noncontact thermometer (IT-314 manufactured by As-One Corporation). The 20° glossiness was determined in accordance with Japanese Industrial Standards, JIS Z 8741.

TABLE 2

| Minimum film forming temperature of liquid composition aggregated layer and temperature at second fixing unit | | |
|---|---|---|
| | First liquid composition aggregated layer | Second liquid composition aggregated layer |
| Temperature ($T_2$) | 138° C. | 138° C. |
| Temperature ($T_3$) | 63° C. | 63° C. |
| Minimum film forming temperature | 160° C. | 120° C. |
| 20° glossiness | 15 | 41 |

As shown in Table 2, the area where the first liquid composition aggregated layer 61 is present on the recording medium surface has a low glossiness, whereas the area where the second liquid composition aggregated layer 62 is present on the recording medium surface has a high glossiness.

In this manner, the first liquid composition aggregated layer 61 and the second liquid composition aggregated layer 62 are fixed by the first fixing unit 18 while being heated at a temperature not lower than each minimum film forming temperature, forming a recorded image having scratch resistance. Next, the second fixing unit 19 is used to perform pressurization and heating of the recording medium 11 once again, and the layers are fixed while being heated at a temperature lower than the minimum film forming temperature of the first liquid composition aggregated layer 61 and higher than the minimum film forming temperature of the second liquid composition. Then, the layers are cooled to a separation temperature not higher than the minimum film forming temperature of the second liquid composition while the contact of the fixing belt and the recording medium 11 is maintained, and then are separated. This can make the area where the second liquid composition aggregated layer 62 is present on the surface have high glossiness.

By using the method of this example, an ink jet recording method capable of controlling the glossiness of a finally obtained image into various patterns of low gloss and high gloss can be provided. Although the example described here uses two liquid compositions that differ in minimum film forming temperature of liquid composition aggregated layers thereof, three or more liquid compositions that differ in minimum film forming temperature can also be used.

Example 1-2

Next, a second example of the direct drawing type ink jet recording method of the present invention will be described in detail.

First, the liquid compositions used in the example will be described.

Preparation of Liquid Composition

Liquid compositions were prepared in accordance with the following formulations. Specifically, components were mixed in accordance with the following formulations and thoroughly stirred. The mixture was then subjected to pressure filtration through a microfilter with a pore size of 3.0 μm (manufactured by Fujifilm Corporation), giving a liquid composition.

Formulation of Liquid Composition 71

Corresponding color pigment dispersion liquid (concentration of about 10%) 20%

Resin particle dispersion 1 (concentration of about 20%) 50%

Glycerol 5%

Diethylene glycol 7%

Surfactant 1 0.5%

Pure water 17.5%

Formulation of Liquid Composition 72

Resin particle dispersion 1 (concentration of about 20%) 50%

Glycerol 5%

Diethylene glycol 7%

Surfactant 1 0.5%

Pure water 37.5%

Formulation of Liquid Composition 73

Resin particle dispersion 2 (a concentration of about 20%) 50%

Glycerol 5%

Diethylene glycol 7%

Surfactant 1 0.5%

Pure water 37.5%

The resin contained in the liquid composition used in this example is a resin particle dispersion, but a water-soluble resin may also be used.

Figure 6:
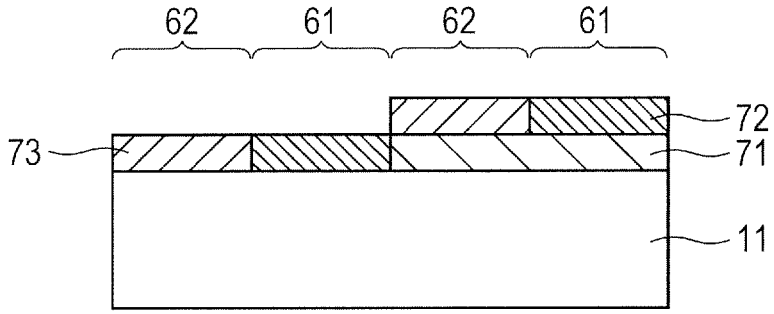
FIG. 6 is a schematic view of a layer structure of liquid composition aggregated layers in Example 1-2.

In this example, a reaction liquid 13 is first applied onto a recording medium 11 by the same procedure as in Example 1-1. Next, when the recording medium 11 arrives at the position of an ink jet recording head 14, black, cyan, magenta, and yellow liquid compositions 71 are ejected from the ink jet recording head 14. The compositions react with the reaction liquid 13 previously applied onto the recording medium 11, forming an image on the recording medium 11. Next, the liquid composition 72 is ejected, then the liquid composition 73 is ejected, and the compositions react with the reaction liquid 13 previously applied onto the recording medium 11, forming liquid composition aggregated layers on the recording medium 11. The structure of the aggregated layers of the liquid compositions in this example is shown in FIG. 6. In the description in this embodiment, liquid composition aggregated layers composed of the liquid composition 71 and the liquid composition 72 having the same minimum film forming temperature are regarded as the first liquid composition aggregated layer 61, and a liquid composition aggregated layer 62 composed of the liquid composition 73 having a low minimum film forming temperature is regarded as the second liquid composition aggregated layer. Next, when the recording medium 11 arrives at an air blower 17, the water contained in the first liquid composition aggregated layer 61 and the second liquid composition aggregated layer 62 is removed by air blowing. Next, the fixation is performed with a first fixing unit 18 and a second fixing unit 19 by the same procedure as in Example 1-1 except that the temperature (T3) upon the separation from the second fixing unit is changed.

Table 3 shows the temperature (T3) upon the separation of the first liquid composition aggregated layer and the second liquid composition aggregated layer 62 from the fixing unit, the minimum film forming temperatures of the first liquid composition aggregated layer 61 and the second liquid composition aggregated layer 62, and the 20-degree glossinesses of the first liquid composition aggregated layer 61 and the second liquid composition aggregated layer 62. These values were determined in the same manner as in Example 1-1.

TABLE 3

| Minimum film forming temperature of liquid composition aggregated layer and temperature at second fixing unit | | |
|---|---|---|
| | First liquid composition aggregated layer | Second liquid composition aggregated layer |
| Temperature ($T_3$) | 54° C. | 54° C. |
| Minimum film forming temperature | 160° C. | 120° C. |
| 20° glossiness | 17 | 52 |

As shown in Table 3, the area where the first liquid composition aggregated layer 61 is present on the recording medium surface has a low glossiness, whereas the area where the second liquid composition aggregated layer 62 is present on the recording medium surface has a high glossiness. The liquid composition 72 and the liquid composition 73 are transparent liquid compositions containing no coloring material, and thus an ink jet recording method capable of forming a pattern of high gloss and low gloss also in the recording medium area where no color image is present can be provided.

Example 2-1

Next, an example of the transfer type ink jet recording method of the present invention will be described.

In this example, as the surface member of an intermediate transfer member, a material prepared by laminating a silicone rubber KE12 having a rubber hardness of 40° and a thickness of 0.1 mm (manufactured by Shin-Etsu Chemical Co., Ltd.) on the surface of a 0.5-mm transparent PET film through a double-sided adhesive tape was used. The surface was subjected to hydrophilization treatment by using a parallel flat plate type atmospheric pressure plasma treatment apparatus APT-203 (manufactured by SEKISUI CHEMICAL CO., LTD.) under the following conditions.

Surface Hydrophilization Conditions

Gas used, flow rate: air, 1,000 cc/min $N_2$, 6,000 cc/min

Input voltage: 230 V

Treatment speed: 20 sec/cm$^2$

Preparation of Reaction Liquid

The reaction liquid used in the present invention was prepared as follows: components of the following formulation were mixed and thoroughly stirred; and then the mixture was subjected to pressure filtration through a microfilter with a pore size of 3.0 μm (manufactured by Fujifilm Corporation), giving the reaction liquid.

Levulinic acid 40 parts

Glycerol 5 parts

Surfactant 1 (trade name, "Acetylenol E 100", manufactured by Kawaken Fine Chemicals CO.) 1 part Resin particles: polyacrylic acid 3 parts Ion-exchanged water 51 parts The liquid compositions used in the example were prepared by the following procedure.

Preparation of Black Pigment Dispersion Liquid

First, 10% of carbon black (product name: Monarch 1100, manufactured by Cabot Corporation), 15% of an aqueous solution of a pigment dispersant (styrene-ethyl acrylate-acrylic acid copolymer with an acid value of 150 and a weight average molecular weight of 8,000; solid content of 20%; neutralized with potassium hydroxide), and 75% of pure water were mixed. The mixture was placed in a batch type vertical sand mill (manufactured by Aimex Co.), and 200% of 0.3-mm zirconia beads were placed. The mixture was dispersed for 5 hours while being cooled with water. The dispersion liquid was subjected to a centrifuge separator to remove coarse particles, giving a black pigment dispersion liquid having a pigment concentration of about 10%.

Preparation of Cyan Pigment Dispersion Liquid

A cyan pigment dispersion liquid was prepared in the same manner as in the preparation of a black pigment dispersion liquid except that 10% of carbon black used in the preparation of a black pigment dispersion liquid was replaced with 10% of C.I. Pigment Blue 15:3.

Preparation of Magenta Pigment Dispersion Liquid

A magenta pigment dispersion liquid was prepared in the same manner as in the preparation of a black pigment dispersion liquid except that 10% of carbon black used in the preparation of a black pigment dispersion liquid was replaced with 10% of C.I. Pigment Red 122.

Preparation of Yellow Pigment Dispersion Liquid

A yellow pigment dispersion liquid was prepared in the same manner as in the preparation of a black pigment dispersion liquid except that 10% of carbon black used in the preparation of a black pigment dispersion liquid was replaced with 10% of C.I. Pigment Yellow 74.

Preparation of Resin Particle Dispersion 1

First, 18% of butyl methacrylate, 2% of 2,2'-azobis-(2-methylbutyronitrile), and 2% of n-hexadecane were mixed and stirred for 0.5 hour. The mixture was added dropwise to 78% of a 6% aqueous solution of "NIKKOL BC15" (trade name, manufactured by Nikko Chemicals Co.) which is an emulsifier, and the resulting mixture was stirred for 0.5 hour. Next, the mixture was sonicated with a sonicator for 3 hours. Subsequently, the mixture was polymerized under a nitrogen atmosphere at 80° C. for 4 hours. The reaction mixture was cooled to room temperature and then filtered, giving a resin particle dispersion having a concentration of about 20%. The resin particles had a mass average molecular weight of about 200,000 and a dispersion particle diameter of about 100 nm to 500 nm.

Preparation of Resin Particle Dispersion 2

A resin particle dispersion 2 was prepared in the same manner as in the preparation of a resin particle dispersion 1 except that 18% of butyl methacrylate used in the preparation of a resin particle dispersion 1 was replaced with 18% of polyethyl methacrylate.

Preparation of Liquid Composition

In accordance with the following formulations, black, cyan, magenta, and yellow liquid compositions were prepared as the liquid compositions 63', and a liquid composition containing no coloring material was prepared as the liquid composition 64'. Specifically, components of the following formulations were mixed and thoroughly stirred. The mixture was then subjected to pressure filtration through a microfilter with a pore size of 3.0 (manufactured by Fujifilm Corporation), giving a liquid composition.

Formulation of Liquid Composition 63'

Corresponding color pigment dispersion liquid (concentration of about 10%) 20%

Resin particle dispersion 1 (concentration of about 20%) 50%

Glycerol 5%

Diethylene glycol 7%

Surfactant 1 0.5%

Pure water 17.5%

Formulation of Liquid Composition 64'

Resin particle dispersion 2 (concentration of about 20%) 50%

Glycerol 5%

Diethylene glycol 7%

Surfactant 1 0.5%

Pure water 37.5%

The principal part of the example will next be described in detail with reference to drawings.

Figure 7:
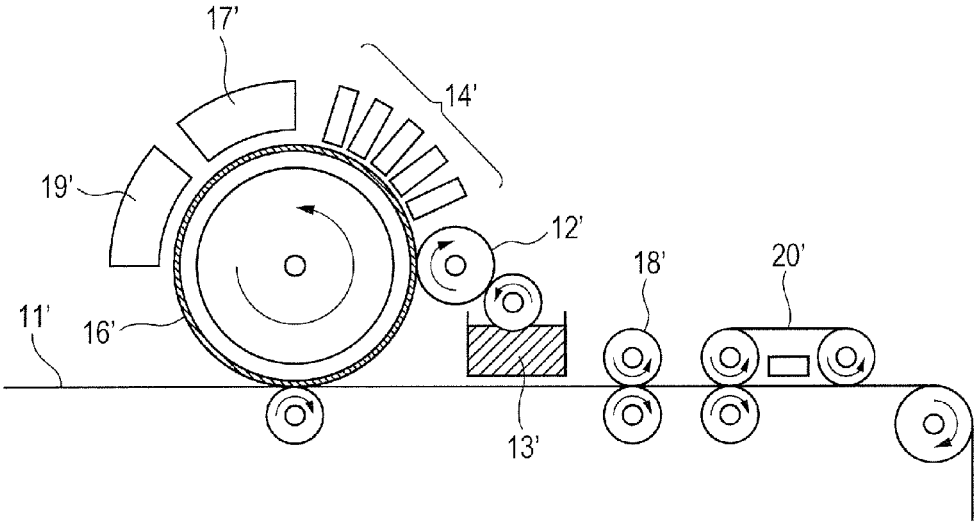
FIG. 7 is a schematic view of a transfer type ink jet printer in an embodiment of the present invention.
Figure 8A:
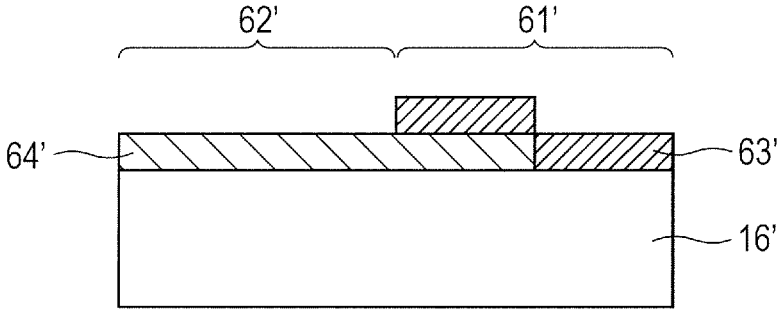
FIGS. 8A and 8B are schematic views of a layer structure of liquid composition aggregated layers in Example 2-1.

FIG. 7 is a schematic view of an ink jet recording method in an embodiment of the present invention. In FIG. 7, an intermediate transfer member 16' is supported on a rotatable cylindrical-shaped support member. The support member is rotationally driven in the arrow direction around an axis as the center. Each device arranged around the intermediate transfer member works in such a way as to be synchronized with the rotation of the support member. A reaction liquid 13' is applied to the intermediate transfer member 16' by using a roller type coating apparatus 12'. Next, when the intermediate transfer member 16' arrives at the position of an ink jet recording head 14', a liquid composition 64' is ejected from the ink jet recording head 14', and the composition reacts with the reaction liquid 13' previously applied onto the intermediate transfer member 16', forming a second liquid composition aggregated layer 62' on the intermediate transfer member 16'. Next, the black, cyan, magenta, and yellow liquid compositions 63' are ejected to form a first liquid composition aggregated layer 61', and the layer structure as shown in FIG. 8A is constructed. In the description in the embodiment, a liquid composition aggregated layer composed of the liquid composition 63' having a high minimum film forming temperature is regarded as the first liquid composition aggregated layer, and a liquid composition aggregated layer composed of the liquid composition 64' having a low minimum film forming temperature is regarded as the second liquid composition aggregated layer.

When the intermediate transfer member 16' arrives at an air blower 17', the water contained in the first liquid composition aggregated layer 61' and the second liquid composition aggregated layer 62' is removed by air blowing.

Figure 8B:
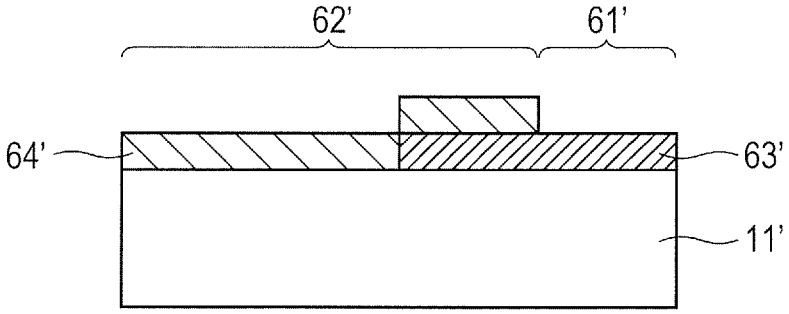

Next, the intermediate transfer member 16' is heated with a heater 19' so that the liquid composition aggregated layers have a predetermined temperature, and then the transfer is performed to a recording medium 11' under conditions of a pressure of 98 N/cm$^2$ (10 kgf/cm$^2$), a transfer temperature of 60° C., and a transfer time of 100 ms. The structure of the liquid composition aggregated layers after the transfer step is shown in FIG. 8B. As shown in FIGS. 8A and 8B, the second liquid composition aggregated layer 62' formed on the bottom in the liquid composition aggregated layers on the intermediate transfer member 16' is formed on the surface in the liquid composition aggregated layers on the recording medium 11' after the transfer step.

Next, when the layers arrive at the position of a first fixing unit 18', the first liquid composition aggregated layer 61' and the second liquid composition aggregated layer 62' are fixed by heating and pressurization. In this example, a roller nip system shown in FIG. 3 was used as the first fixing unit 18'. As the surface base material of a heating roller 41', silicone rubber is used. The temperature of the heating roller 41' was set at 180° C. so that the temperature of the first liquid composition aggregated layer 61' and the second liquid composition aggregated layer 62' upon the fixation was sufficiently higher than the minimum film forming temperatures of the liquid compositions contained in the first liquid composition aggregated layer 61' and the second liquid composition aggregated layer 62', and the pressure for pressurization was set at 98 N/cm$^2$. The time of nipping between the heating roller 41' and a support roller 42' was set at 900 msec.

Table 4 shows the temperature of the first liquid composition aggregated layer 61' and the second liquid composition aggregated layer 62' at this fixation and the minimum film forming temperatures of the first liquid composition aggregated layer 61' and the second liquid composition aggregated layer 62'. The temperature of the liquid composition aggregated layers upon the fixation was determined by measuring the temperature of the liquid composition aggregated layers on the recording medium 11' immediately after the fixation nipping with a noncontact thermometer (IT-314 manufactured by As-One Corporation).

As shown in Table 4, the temperature of the first and second liquid composition aggregated layers 61' and 62' upon the fixation is higher than each minimum film forming temperature, and thus the first and second liquid composition aggregated layers 61' and 62' undergo film formation and are fixed.

The first and second liquid composition aggregated layers 61' and 62' after the separation have low glossiness. This is thought to be because the layers are separated at a temperature higher than each minimum film forming temperature and thus the surface has an uneven shape due to, for example, a tacking force to the heating roller 41' upon the separation.

TABLE 4

Minimum film forming temperature of liquid composition aggregated layer and temperature upon fixation

| | First liquid composition aggregated layer | Second liquid composition aggregated layer |
|---|---|---|
| Temperature upon fixation ($T_1$) | 178° C. | 178° C. |
| Minimum film forming temperature | 160° C. | 120° C. |

Next, when the layers arrive at the position of a second fixing unit 20', the first liquid composition aggregated layer 61' and the second liquid composition aggregated layer 62' are subjected to pressurization and heating. In this example, an endless press system shown in FIG. 4 is used as the second fixing unit 20'. As the surface base material of a fixing belt 51', a smooth polyimide film ("Kapton" (registered trademark), manufactured by DU PONT-TORAY Co., Ltd.) was used. The temperature of a heating roller 41' was set at 140° C. so that the temperature of the first liquid composition aggregated layer 61' upon the fixation was sufficiently lower than the minimum film forming temperature of a liquid composition contained in the first liquid composition aggregated layer 61' and was sufficiently higher than the minimum film forming temperature of a liquid composition contained in the second liquid composition aggregated layer 62', and the pressure for pressurization was set at 98 N/cm$^2$. The time of nipping between the fixing belt 51' and a support roller 42 was set at 900 msec.

The temperature of the first liquid composition aggregated layer 61' upon the heating and pressurization by the second fixing unit (upon the fixation nipping) is sufficiently lower than the minimum film forming temperature of the first liquid composition aggregated layer 61'. Accordingly, the surface of the first liquid composition aggregated layer 61' is not deformed by the fixing belt 51', and thus the uneven surface shape still remains. The temperature of the first and second liquid composition aggregated layers upon the heating and pressurization by the second fixing unit is sufficiently higher than the minimum film forming temperature of the second liquid composition aggregated layer 62', and thus the surface of the second liquid composition aggregated layer 62' is supposed to be deformed into a smooth surface shape in accordance with the smooth surface of the fixing belt 51'.

After the fixation nipping, the liquid composition aggregated layers are cooled while the contact of the fixing belt 51' and the liquid composition aggregated layers is maintained, and are separated at a low temperature. When the temperature of the second liquid composition aggregated layer upon the separation is lower than the minimum film forming temperature of the second liquid composition, the second liquid composition aggregated layer 62' has sufficient hardness, and thus the layers are separated while maintaining the smooth surface shape of the fixing belt, giving high glossiness.

Table 5 shows the temperature upon the fixation nipping and the temperature upon the separation of the first liquid composition aggregated layer 61' and the second liquid composition aggregated layer 62', the minimum film forming temperatures of the first liquid composition aggregated layer 61' and the second liquid composition aggregated layer 62', and the 20-degree glossinesses of the first liquid composition aggregated layer 61' and the second liquid composition aggregated layer 62'. The temperature of the liquid composition aggregated layers upon the fixation nipping was determined under such a condition that a temperature-indicating label (CR-D manufactured by MICRON Co.) was placed on the recording medium and the fixation was performed. The temperature of the liquid composition aggregated layers upon the fixation separation was determined with a noncontact thermometer (IT-314 manufactured by As-One Corporation). The 20° glossiness was determined in accordance with Japanese Industrial Standards, JIS Z 8741.

TABLE 5

| Minimum film forming temperature of liquid composition aggregated layer and temperature at second fixing unit | | |
|---|---|---|
| | First liquid composition aggregated layer | Second liquid composition aggregated layer |
| Temperature upon fixation nipping ($T_2$) | 138° C. | 138° C. |

TABLE 5-continued

| Minimum film forming temperature of liquid composition aggregated layer and temperature at second fixing unit | | |
|---|---|---|
| | First liquid composition aggregated layer | Second liquid composition aggregated layer |
| Temperature upon fixation separation ($T_3$) | 67° C. | 67° C. |
| Minimum film forming temperature | 160° C. | 120° C. |
| 20° glossiness | 12 | 44 |

As shown in Table 5, the area where the first liquid composition aggregated layer 61' is present on the recording medium surface has a low glossiness, whereas the area where the second liquid composition aggregated layer 62' is present on the recording medium surface has a high glossiness. By using this example, an ink jet recording method capable of forming various patterns of high gloss and low gloss can be provided even when the image formation is performed by the transfer system.

Example 2-2

Next, a second example of the transfer type ink jet recording method of the present invention will be described in detail.

Preparation of Liquid Composition

Liquid compositions were prepared in accordance with the following formulations. Specifically, components of the following formulations were and thoroughly stirred, and then the mixture was then subjected to pressure filtration through a microfilter with a pore size of 3.0 (manufactured by Fujifilm Corporation), giving a liquid composition. As for the minimum film forming temperatures of resin solid contents in the following liquid compositions, the minimum film forming temperatures of a liquid composition 71' and a liquid composition 72' constituting the first liquid composition aggregated layer are 160° C., and the minimum film forming temperature of a liquid composition 73' constituting the second liquid composition aggregated layer is 120° C.

Formulation of Liquid Composition 71'

Corresponding color pigment dispersion liquid (concentration of about 10%) 20%
Resin particle dispersion 1 (concentration of about 20%) 50%
Glycerol 5%
Diethylene glycol 7%
Surfactant 1 0.5%
Pure water 17.5%

Formulation of Liquid Composition 72

Resin particle dispersion 1 (concentration of about 20%) 50%
Glycerol 5%
Diethylene glycol 7%
Surfactant 1 0.5%
Pure water 37.5%

Formulation of Liquid Composition 73

Resin particle dispersion 2 (concentration of about 20%) 50%
Glycerol 5%
Diethylene glycol 7%
Surfactant 1 0.5%
Pure water 37.5%

In this example, a reaction liquid 13' is first applied onto an intermediate transfer member 16' by the same procedure as in Example 2-1. Next, when the intermediate transfer member 16' arrives at the position of an ink jet recording head 14', a liquid composition 72' is ejected from the ink jet recording head 14', then a liquid composition 73' is ejected, and the respective compositions react with the reaction liquid 13' previously applied onto the intermediate transfer member 16', forming liquid composition aggregated layers on the intermediate transfer member 16'. Next, the black, cyan, magenta, and yellow liquid compositions 71' are ejected and react with the reaction liquid 13' previously applied onto the intermediate transfer member 16', forming an image on the intermediate transfer member 16'.

Figure 9A:
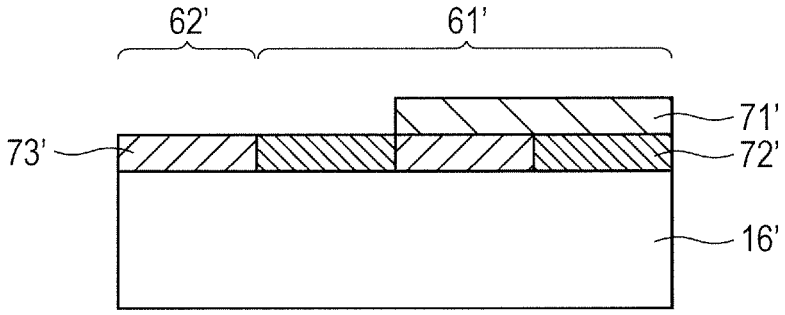
FIGS. 9A and 9B are schematic views of a layer structure of liquid composition aggregated layers in Example 2-2.

The structure of the liquid composition aggregated layers in this example is shown in FIG. 9A. In the description in the embodiment, liquid composition aggregated layers composed of the liquid composition 71' and the liquid composition 72' having the same minimum film forming temperature are regarded as the first liquid composition aggregated layer, and a liquid composition aggregated layer composed of the liquid composition 73' having a low minimum film forming temperature is regarded as the second liquid composition aggregated layer.

When the intermediate transfer member 16' arrives at an air blower 17', the water contained in the first liquid composition aggregated layer 61' and the second liquid composition aggregated layer 62' is removed by air blowing.

Figure 9B:
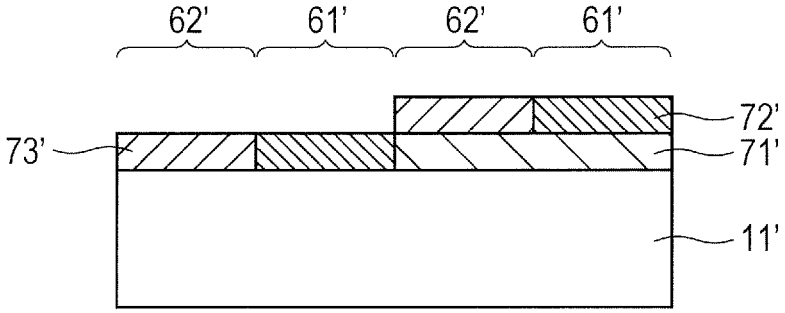

Next, the intermediate transfer member 16' is heated with a heater 19' so that the liquid composition aggregated layers have a predetermined temperature, and then the transfer is performed to a recording medium 11' under conditions of a pressure of 98 N/cm$^2$, a transfer temperature of 100° C., and a transfer time of 100 ms. The structure of the liquid composition aggregated layers after the transfer step is shown in FIG. 9B. As shown in FIGS. 9A and 9B, the pattern of the first liquid composition aggregated layer 61' composed of the liquid composition 72' and the second liquid composition aggregated layer 62' composed of the liquid composition 73' formed on the bottom in the liquid composition aggregated layers on the intermediate transfer member 16' is formed on the surface of the liquid composition aggregated layers on the recording medium 11' after the transfer step.

Next, the fixation is performed with a first fixing unit 18' and a second fixing unit 20 by the same procedure as in Example 2-1 except that the temperature (T3) upon the separation from the second fixing unit is changed.

Table 6 shows the temperature upon the fixation nipping and the temperature upon the separation of the first liquid composition aggregated layer 61' and the second liquid composition aggregated layer 62', the minimum film forming temperatures of the first liquid composition aggregated layer 61' and the second liquid composition aggregated layer 62', and the 20-degree glossinesses of the first liquid composition aggregated layer 61' and the second liquid composition aggregated layer 62'.

TABLE 6

| Minimum film forming temperature of liquid composition aggregated layer and temperature at second fixing unit | | |
|---|---|---|
| | First liquid composition aggregated layer | Second liquid composition aggregated layer |
| Temperature upon fixation nipping ($T_2$) | 138° C. | 138° C. |

TABLE 6-continued

| Minimum film forming temperature of liquid composition aggregated layer and temperature at second fixing unit | | |
|---|---|---|
| | First liquid composition aggregated layer | Second liquid composition aggregated layer |
| Temperature upon fixation separation ($T_3$) | 48° C. | 48° C. |
| Minimum film forming temperature | 160° C. | 120° C. |
| 20° glossiness | 14 | 57 |

As shown in Table 6, the area where the first liquid composition aggregated layer 61' is present on the recording medium surface has a low glossiness, whereas the area where the second liquid composition aggregated layer 62' is present on the recording medium surface has a high glossiness.

The liquid composition 72' and the liquid composition 73' are transparent liquid compositions containing no coloring material, and thus a transfer type ink jet recording method capable of forming a pattern of high gloss and low gloss in the recording medium area where no image is present can be provided.

Example 2-3

Figure 10:
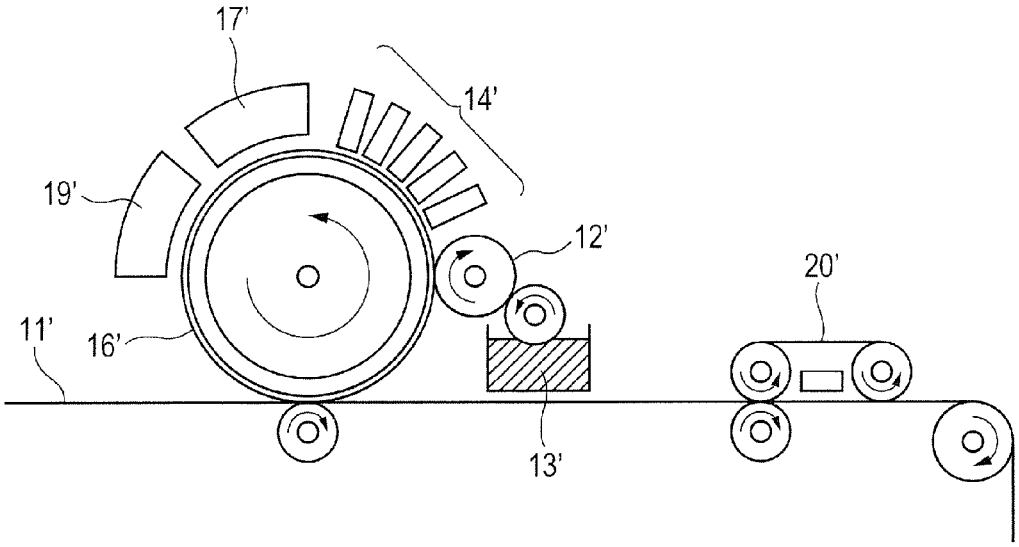
FIG. 10 is a schematic view of an ink jet printer in an embodiment of the present invention.

Next, a third example of the transfer type ink jet recording method of the present invention will be described in detail with reference to FIG. 10.

Preparation of Liquid Composition

The liquid compositions used in the example are the liquid composition 63' and the liquid composition 64' used in Example 2-1.

In this example, a reaction liquid 13' is first applied onto an intermediate transfer member 16' by the same procedure as in Example 2-1. Next, when the intermediate transfer member 16' arrives at the position of an ink jet recording head 14', a liquid composition 63' is ejected from the ink jet recording head 14', then a liquid composition 64' is ejected, and the respective compositions react with the reaction liquid 13' previously applied onto the intermediate transfer member 16', forming liquid composition aggregated layers on the intermediate transfer member 16'.

When the intermediate transfer member 16' arrives at an air blower 17', the water contained in the first liquid composition aggregated layer 61' and the second liquid composition aggregated layer 62' is removed by air blowing.

Next, the intermediate transfer member 16' is heated with a heater 19' so that the liquid composition aggregated layers have a predetermined temperature, and then the transfer is performed to a recording medium 11' under conditions of a pressure of 98 N/cm$^2$, a transfer temperature of 180° C., and a transfer time of 900 ms.

Table 7 shows the temperature of the first liquid composition aggregated layer 61' and the second liquid composition aggregated layer 62' in the transfer step and the minimum film forming temperatures of the first liquid composition aggregated layer 61' and the second liquid composition aggregated layer 62'. The temperature of the liquid composition aggregated layers on the recording medium 11' immediately after the transfer nipping was determined with a noncontact thermometer. As shown in Table 7, the temperature of the first liquid composition aggregated layer 61' and the second liquid composition aggregated layer 62' upon the transfer nipping is higher than each minimum film forming temperature, and thus the first and second liquid composition aggregated layers 61' and 62' are fixed to the recording medium 11'. The layers are separated from the transfer roller at a temperature higher than each minimum film forming temperature, and thus the surface has an uneven shape and low glossiness due to, for example, a tacking force to the intermediate transfer member upon the separation.

TABLE 7

| Minimum film forming temperature of liquid composition aggregated layer and temperature upon transfer | | |
|---|---|---|
| | First liquid composition aggregated layer | Second liquid composition aggregated layer |
| Temperature upon transfer | 172° C. | 172° C. |
| Minimum film forming temperature | 160° C. | 120° C. |

Next, without passing through a first fixing unit, a second fixation step is directly performed with an endless press type second fixing unit 20'. Table 8 shows the temperature upon the fixation nipping and the temperature upon the separation of the first liquid composition aggregated layer 61' and the second liquid composition aggregated layer 62', the minimum film forming temperatures of the first liquid composition aggregated layer 61' and the second liquid composition aggregated layer 62', and the 20-degree glossinesses of the first liquid composition aggregated layer 61' and the second liquid composition aggregated layer 62'.

TABLE 8

| Minimum film forming temperature of liquid composition aggregated layer and temperature at second fixing unit | | |
|---|---|---|
| | First liquid composition aggregated layer | Second liquid composition aggregated layer |
| Temperature upon fixation nipping | 138° C. | 138° C. |
| Temperature upon fixation separation | 63° C. | 63° C. |
| Minimum film forming temperature | 160° C. | 120° C. |
| 20° glossiness | 15 | 44 |

As shown in Table 8, the area where the first liquid composition aggregated layer 61' is present on the surface of the recording medium 11' has a low glossiness, whereas the area where the second liquid composition aggregated layer 62' is present on the surface of the recording medium 11' has a high glossiness. By using this example, an ink jet recording method capable of forming various patterns of high gloss and low gloss can be provided even when the image formation is performed by a two-step transfer system.

Example 2-4

Next, a fourth example of the transfer type ink jet recording method of the present invention will be described in detail.

Preparation of Liquid Composition

The liquid compositions used in this example are the liquid composition 63' and the liquid composition 64' used in Example 2-1.

Figure 11:
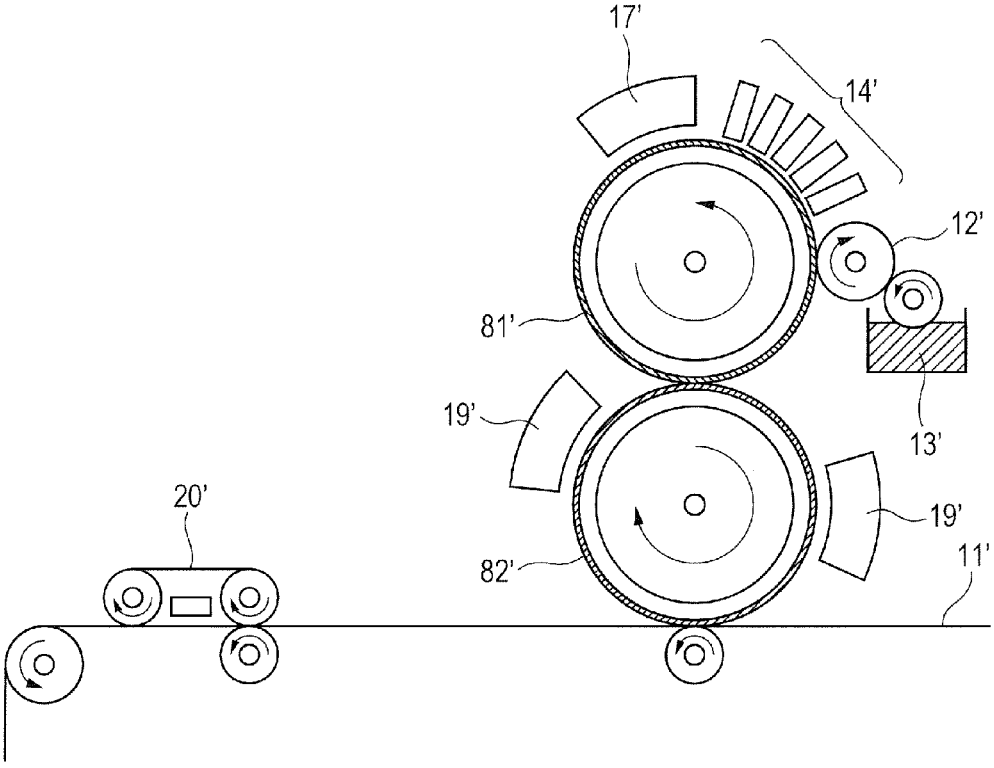
FIG. 11 is a schematic view of an ink jet printer in an embodiment of the present invention.

FIG. 11 is a view schematically illustrating a transfer type ink jet recording method using a two-step transfer system. In this method, liquid compositions are used to form an intermediate image on a first intermediate transfer member 81'; then the intermediate image on the first intermediate transfer member 81' is transferred onto a second intermediate transfer member 82' that has a higher temperature than that of the first intermediate transfer member 81' and is in contact therewith; and the image on the second intermediate transfer member 82' at high temperature is further transferred to a recording medium 11', obtaining an image printed article.

In this example, a reaction liquid 13' is first applied onto a first intermediate transfer member 81' by the same procedure as in Example 2-1. Next, when the first intermediate transfer member 81' arrives at the position of an ink jet recording head 14', black, cyan, magenta, and yellow liquid compositions 63' are ejected from the ink jet recording head 14', and the respective compositions react with the reaction liquid 13' previously applied onto the first intermediate transfer member 81', forming a first liquid composition aggregated layer on the first intermediate transfer member 81'. Next, a liquid composition 64' is ejected to react with the reaction liquid 13' previously applied onto the first intermediate transfer member 81' to form a second liquid composition aggregated layer on the first intermediate transfer member 81, forming an intermediate image composed of the first and second liquid composition aggregated layers.

Figure 12A:
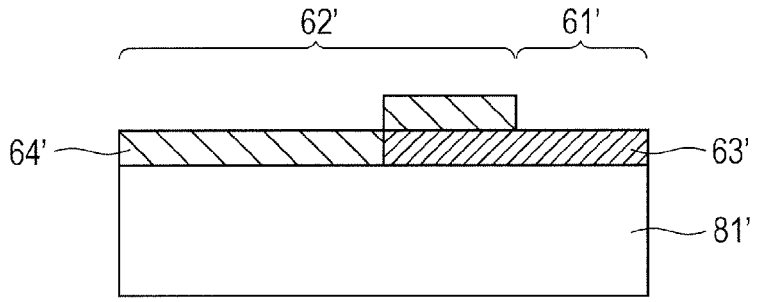
FIGS. 12A, 12B and 12C are schematic views of a layer structure of liquid composition aggregated layers in Example 2-4.

The structure of the liquid composition aggregated layers on the first intermediate transfer member 81' in this example is shown in FIG. 12A. In the description in this embodiment, a liquid composition aggregated layer composed of the liquid composition 63' having a high minimum film forming temperature is regarded as the first liquid composition aggregated layer 61', and a liquid composition aggregated layer composed of the liquid composition 64' having a low minimum film forming temperature is regarded as the second liquid composition aggregated layer 62'.

When the intermediate transfer member 81' arrives at an air blower 17', the water contained in the first liquid composition aggregated layer 61' and the second liquid composition aggregated layer 62' is removed by air blowing.

Next, a first fixation step is performed concurrently with the transfer from the first intermediate transfer member 81' to a second intermediate transfer member 82' heated with a heater 19' to maintain a temperature of 180° C. under conditions of a pressure of 98 $N/cm^2$ (10 $kgf/cm^2$) and a transfer time of 100 ms.

Figure 12B:
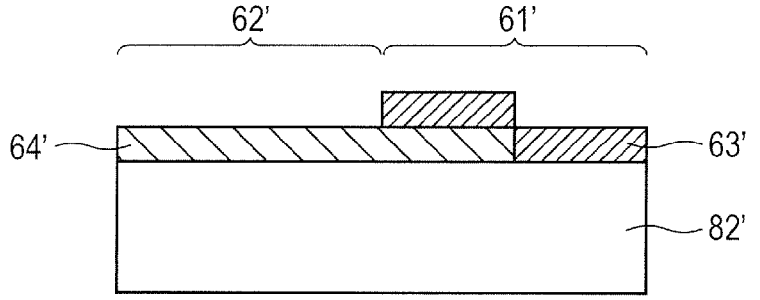
Figure 12C:
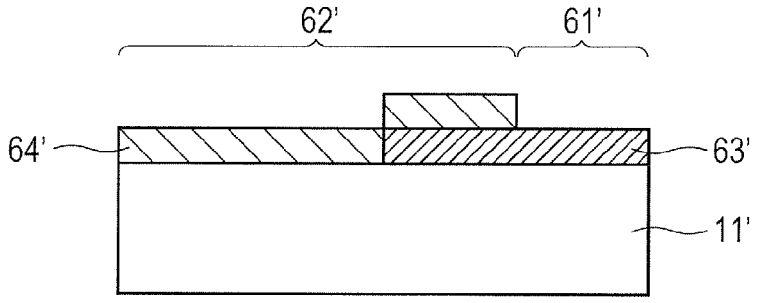

Next, the transfer is performed by the same procedure as in Example 2-3. The structure of the liquid composition aggregated layers after the transfer step is shown in FIG. 12C. As shown in FIGS. 12B and 12C, the pattern of the first liquid composition aggregated layer 61' and the second liquid composition aggregated layer 62' formed on the bottom in the liquid composition aggregated layers on the second intermediate transfer member 82' is formed on the surface of the liquid composition aggregated layers on the recording medium 11 after the transfer step.

Next, the fixation is performed with a second fixing unit 20 by the same procedure as in Example 2-3 except that the temperature upon the fixation separation is changed.

Table 9 shows the temperature upon the fixation nipping and the temperature upon the separation of the first liquid composition aggregated layer 61' and the second liquid composition aggregated layer 62', the minimum film forming temperatures of the first liquid composition aggregated layer 61' and the second liquid composition aggregated layer 62', and the 20-degree glossinesses of the first liquid composition aggregated layer 61' and the second liquid composition aggregated layer 62'.

TABLE 9

Minimum film forming temperature of liquid composition aggregated layer and temperature with second fixing unit

| | First liquid composition aggregated layer | Second liquid composition aggregated layer |
|---|---|---|
| Temperature upon fixation nipping | 138° C. | 138° C. |
| Temperature upon fixation separation | 52° C. | 52° C. |
| Minimum film forming temperature | 160° C. | 120° C. |
| 20° glossiness | 19 | 51 |

As shown in Table 9, the area where the first liquid composition aggregated layer 61' is present on the surface of the recording medium 11' has a low glossiness, whereas the area where the second liquid composition aggregated layer 62' is present on the surface of the recording medium 11' has a high glossiness. By using this example, an ink jet recording method capable of forming various patterns of high gloss and low gloss can be provided even when the image formation is performed by a two-step transfer system.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-084373, filed Apr. 16, 2015, and Japanese Patent Application No. 2015-084374, filed Apr. 16, 2015 which are hereby incorporated by reference herein in their entirety.

What is claimed is:

1. An ink jet recording method comprising:

a step of forming a first liquid composition aggregated layer by applying a first liquid composition containing a resin to a recording medium by using an ink jet recording head;

a step of forming a second liquid composition aggregated layer by applying a second liquid composition containing a resin to the recording medium by using an ink jet recording head;

a first fixation step of performing heating and pressurization of the recording medium on which the first liquid composition aggregated layer and the second liquid composition aggregated layer are formed by using a first fixing unit; and a second fixation step, wherein the second fixation step comprises performing heating and pressurization of the recording medium subjected to the first fixation step by using a second fixing unit followed by cooling the recording medium to separate the recording medium from the second fixing unit, and wherein $$MFT1>MFT2, \quad (1\text{-}1)$$

and $$T1>MFT1\geq T2>MFT2\geq T3 \quad (1\text{-}2)$$

are satisfied, where MFT1 is a minimum film forming temperature of the first liquid composition aggregated layer, MFT2 is a minimum film forming temperature of the second liquid composition aggregated layer, T1 is a temperature of the first liquid composition aggregated layer and the second liquid composition aggregated layer upon the heating and pressurization in the first fixation step, T2 is a temperature of the first liquid composition aggregated layer and the second liquid composition aggregated layer upon the heating and pressurization in the second fixation step, and T3 is a temperature of the first liquid composition aggregated layer and the second liquid composition aggregated layer upon the separation in the second fixation step.

2. The ink jet recording method according to claim 1, wherein the second fixation step comprises, after performing the heating and pressurization by using the second fixing unit, cooling the recording medium to a temperature not higher than the minimum film forming temperature (MFT2) of the second liquid composition aggregated layer while contact of the second fixing unit with the recording medium is maintained to separate the recording medium from the second fixing unit.

3. The ink jet recording method according to claim 1, wherein at least one of the first liquid composition and the second liquid composition contains a coloring material.

4. The ink jet recording method according to claim 1, wherein the first liquid composition contains a coloring material.

5. The ink jet recording method according to claim 1, wherein the second liquid composition contains no coloring material.

6. An ink jet recording method comprising:

a step of forming a first liquid composition aggregated layer by applying a first liquid composition containing a resin to an intermediate transfer member by using an ink jet recording head;

a step of forming a second liquid composition aggregated layer by applying a second liquid composition containing a resin to the intermediate transfer member by using an ink jet recording head;

a transfer step of transferring the first liquid composition aggregated layer and the second liquid composition aggregated layer on the intermediate transfer member onto a recording medium;

a first fixation step of performing heating and pressurization of the recording medium on which the first liquid composition aggregated layer and the second liquid composition aggregated layer are formed by using a first fixing unit; and a second fixation step, wherein the second fixation step comprises performing heating and pressurization of the recording medium subjected to the first fixation step by using a second fixing unit followed by cooling the recording medium to separate the recording medium from the second fixing unit, and wherein $$MFT1>MFT2, \quad (2\text{-}1)$$

and $$T1>MFT1\geq T2>MFT2\geq T3 \quad (2\text{-}2)$$

are satisfied, where MFT1 is a minimum film forming temperature of the first liquid composition aggregated layer, MFT2 is a minimum film forming temperature of the second liquid composition aggregated layer, T1 is a temperature of the first liquid composition aggregated layer and the second liquid composition aggregated layer upon the heating and pressurization in the first fixation step, T2 is a temperature of the first liquid composition aggregated layer and the second liquid composition aggregated layer upon the heating and pressurization in the second fixation step, and T3 is a temperature of the first liquid composition aggregated layer and the second liquid composition aggregated layer upon the separation in the second fixation step.

7. The ink jet recording method according to claim 6, wherein the first fixation step is performed concurrently with the transfer step.

8. The ink jet recording method according to claim 6, wherein the first fixation step is performed after the transfer step.

9. The ink jet recording method according to claim 6, wherein the second fixation step comprises, after performing the heating and pressurization by using the second fixing unit, cooling the recording medium to a temperature not higher than the minimum film forming temperature (MFT2) of the second liquid composition aggregated layer while contact of the second fixing unit with the recording medium is maintained to separate the recording medium from the second fixing unit.

10. The ink jet recording method according to claim 6, wherein the intermediate transfer member comprises a first intermediate transfer member and a second intermediate transfer member in contact with the first intermediate transfer member, and wherein the transfer step is a step of transferring the first liquid composition aggregated layer and the second liquid composition aggregated layer from the first intermediate transfer member onto the second intermediate transfer member and transferring the first liquid composition aggregated layer and the second liquid composition aggregated layer from the second intermediate transfer member onto the recording medium, a temperature of the second intermediate transfer member being higher than a temperature of the first intermediate transfer member.

11. The ink jet recording method according to claim 6, wherein at least one of the first liquid composition aggregated layer and the second liquid composition aggregated layer is formed by using a liquid composition containing no coloring material, and the first liquid composition aggregated layer and the second liquid composition aggregated layer are formed on the intermediate transfer member in such a way that the liquid composition aggregated layer containing no coloring material becomes a surface of an image after transfer to the recording medium.

12. The ink jet recording method according to claim 11, wherein the first liquid composition aggregated layer contains a coloring material.

13. The ink jet recording method according to claim 11, wherein the first liquid composition aggregated layer is formed by using a liquid composition containing a coloring material and a liquid composition containing no coloring material.

14. The ink jet recording method according to claim 6, comprising, before the step of forming the first liquid composition aggregated layer, a step of applying to the intermediate transfer member a reaction liquid capable of causing aggregation of a component in the first liquid composition or in the second liquid composition.

* * * * *